US007972188B2

(12) United States Patent
Bernloehr et al.

(10) Patent No.: US 7,972,188 B2
(45) Date of Patent: Jul. 5, 2011

(54) TROLLING MOTOR MOUNT

(75) Inventors: Darrel A. Bernloehr, Mankato, MN (US); Dale Eugene Simonson, Cleveland, MN (US)

(73) Assignee: Johnson Outdoors Inc., Racine, WI (US)

( * ) Notice: Subject to any disclaimer, the term of this patent is extended or adjusted under 35 U.S.C. 154(b) by 532 days.

(21) Appl. No.: 12/221,831

(22) Filed: Aug. 7, 2008

(65) Prior Publication Data

US 2010/0032545 A1 Feb. 11, 2010

(51) Int. Cl.
*B63H 20/08* (2006.01)

(52) U.S. Cl. ..... 440/55; 248/640

(58) Field of Classification Search ..... 440/53, 440/55, 63; 248/640, 642
See application file for complete search history.

(56) References Cited

U.S. PATENT DOCUMENTS 3,948,204 A * 4/1976 Brock et al. ..... 248/642
4,331,430 A 5/1982 Lutzke et al.
4,472,148 A 9/1984 Kollock et al.
4,759,733 A 7/1988 Nishimura
4,826,459 A 5/1989 Slattery
4,846,740 A 7/1989 Forsgren
4,911,398 A 3/1990 Dilulio et al.
4,925,410 A 5/1990 Boda
5,669,794 A 9/1997 Knight et al.
5,755,603 A 5/1998 Kumita
5,855,496 A 1/1999 Lokken
6,390,864 B1 * 5/2002 Jenkins ..... 440/53
6,398,601 B1 6/2002 Oguma
7,407,419 B2 * 8/2008 Douglas ..... 440/53

* cited by examiner

*Primary Examiner* — Lars A Olson
(74) *Attorney, Agent, or Firm* — Reinhart Boerner Van Deuren P.C.

(57) ABSTRACT

An apparatus for mounting a trolling motor to a watercraft includes a bracket, a coupling hinge, a lift arm, a cam mechanism, a collet, a resistance knob, a first bias spring and a second bias spring. The bracket is adapted to mount on a transom or a gunnel of the watercraft. The coupling hinge receives a shaft of the trolling motor therethrough and retains the trolling motor via the collet and resistance knob mounted thereon. The collet and knob can be selectively tightened or loosened about the shaft of the trolling motor. The bracket defines detents and an arcuate track in which a track follower portion of the coupling hinge can move. The movement of the coupling hinge along the bracket tilts the trolling motor between a stowed position and a deployed position. The lift arm is pivotally coupled to the coupling hinge and carries a locking pin. The lift arm is biased by the first bias spring such that the locking pin engages the detents. The cam mechanism is pivotally coupled to the bracket and is biased by the second bias spring to disengage the locking pin from a lower portion of the detents.

21 Claims, 20 Drawing Sheets

22
18
20
34
10
28A
16
14
32A
30A
14B
14A
24
27B
27A
26
25A
15
25B
29B
29A
15
25A
25B

TROLLING MOTOR MOUNT

BACKGROUND

The present invention relates generally to trolling motors and, more particularly, to an apparatus for mounting a trolling motor to a watercraft and for moving and locking the trolling motor in a variety of tilt angle positions between a horizontal stowed position on-board the vessel and a generally vertical operating position in the water.

Watercraft, especially fishing vessels, often employ trolling motors to maneuver or to hold the watercraft in position while the vessel operator fishes. Trolling motors may be interconnected with the watercraft via a mounting bracket secured to the gunnels or transom of the vessel. Conventional mounting brackets are generally adapted with a pivot pin which allows the portion of the bracket adapted to receive the trolling motor to swivel between the stowed position, where the trolling motor is on-board the vessel, and the deployed operation position, where the trolling motor extends into the water.

Although many conventional mounting brackets effectively stow and deploy trolling motors, many require the operator to actuate a lever or other such actuating mechanism to disengage a locking pin (which secures the portion of the bracket adapted to receive the trolling motor in a tilt position relative to the remainder of the bracket assembly) before swiveling the trolling motor to a different tilt position such as the stowed position. Similarly, many conventional mounting brackets require the operator to continue actuating the mechanism to disengage the locking pin for the entire duration of the swiveling of the trolling motor. Requiring the operator to actuate the mechanism to disengage the locking pin before tilting (and during the tilting of) the trolling motor may be inconvenient or undesirable in many situations, including situations where quick upward tilting or stowage of the trolling motor would be expedient. One such situation would occur, for example, when the watercraft enters shallow water where the motor shaft or drive unit of the trolling motor may contact underwater obstructions. In such a situation, it would be convenient and expedient for the operator to quickly tilt and/or stow the trolling motor.

SUMMARY

An apparatus for mounting a trolling motor to a watercraft includes a bracket and a coupling hinge. The bracket is adapted to mount on a transom or a gunnel of the watercraft. The coupling hinge receives and rotatably retains the trolling motor. The coupling hinge and bracket have corresponding male and female surface profiles which form a track that allows the coupling hinge to slide with respect to the bracket along the track to move the trolling motor between a stowed position and a deployed position.

DETAILED DESCRIPTION

Figure 1A:
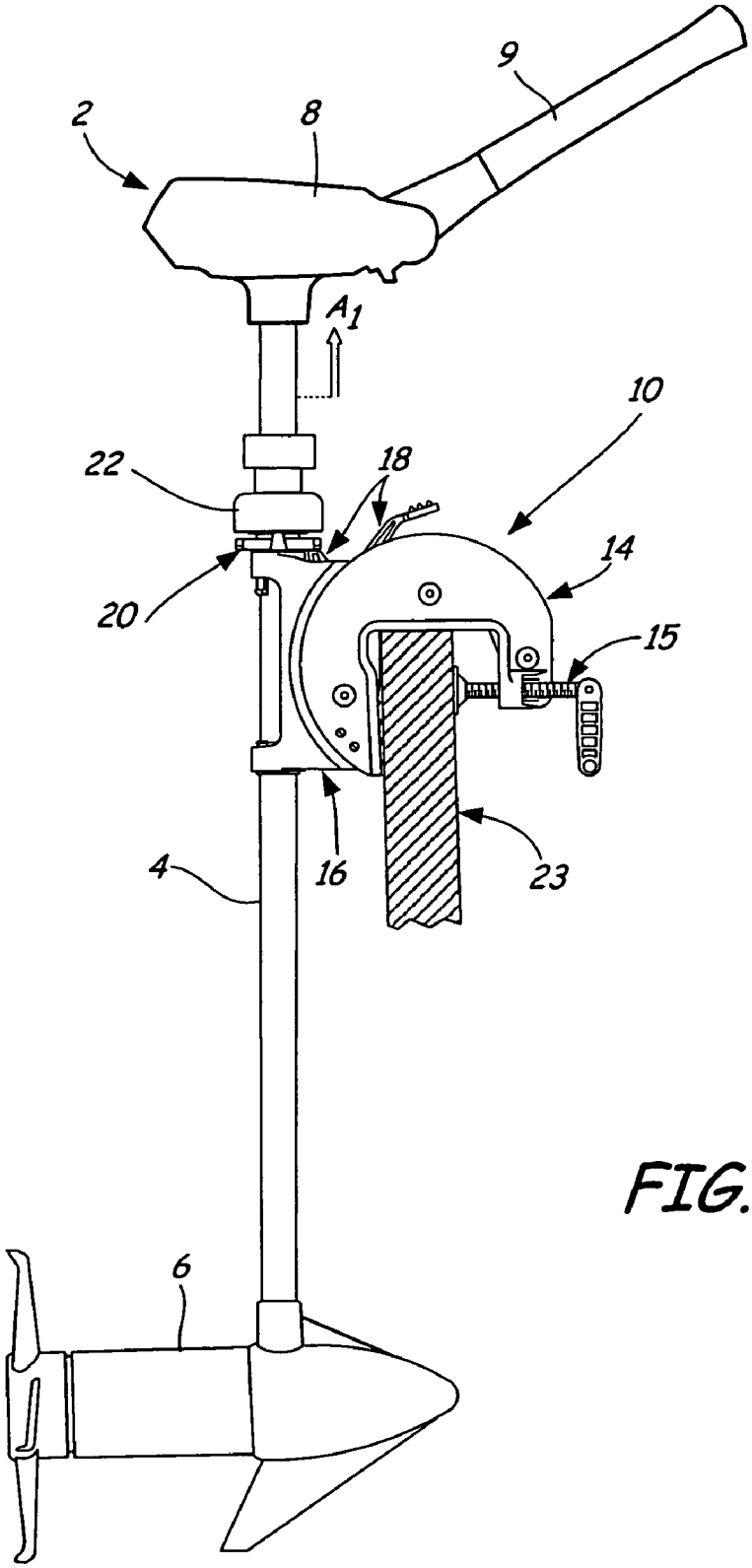
FIG. 1A is a side view of one embodiment of a bracket assembly shown in a deployed position retaining a trolling motor and illustrating an initial stowing actuation by the operator.
Figure 1B:
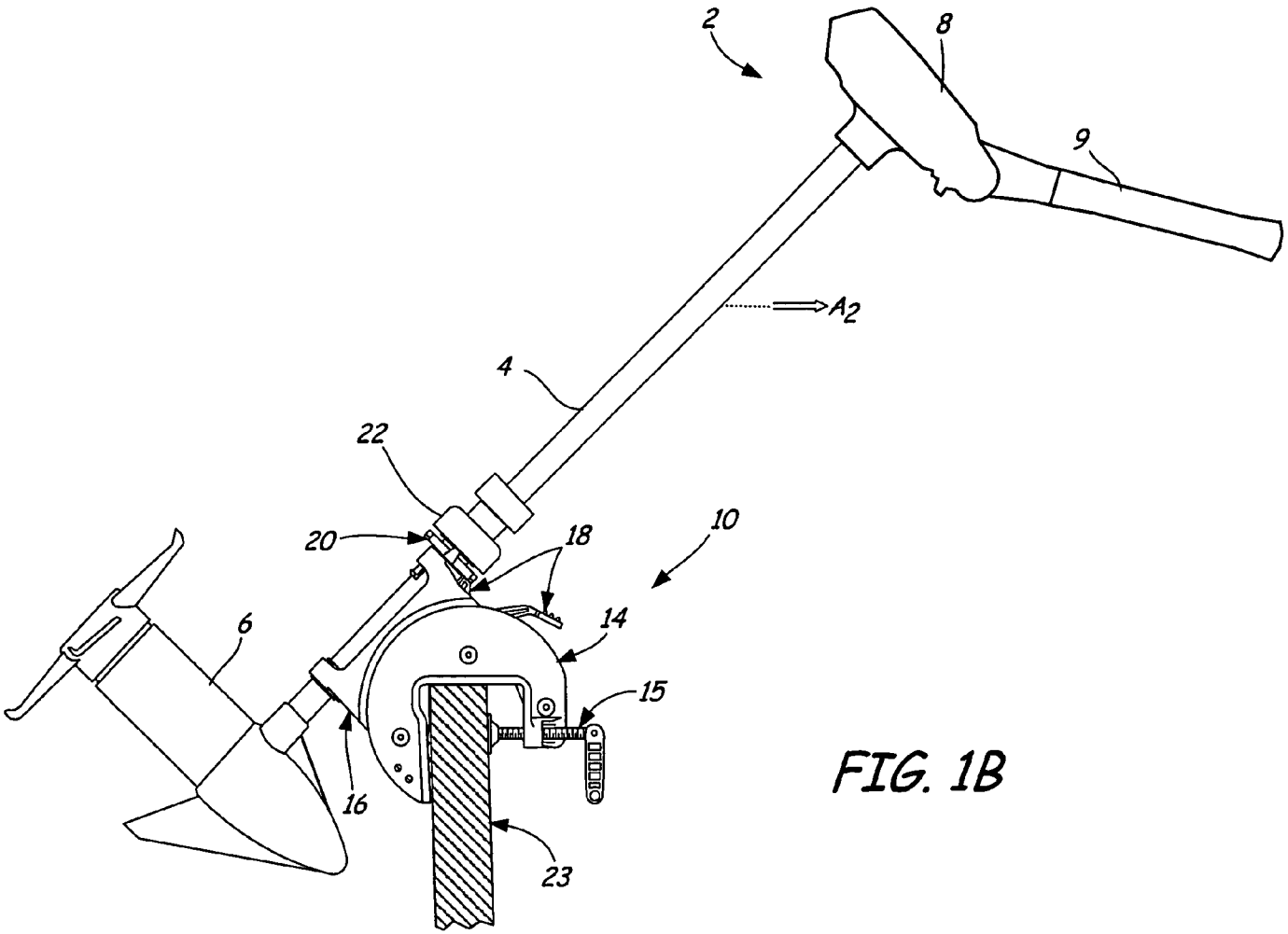
FIG. 1B is a side view of the bracket assembly and trolling motor of FIG. 1A shown in a position between the deployed position and a stowed position and illustrating a further stowing actuation by the operator.
Figure 1C:
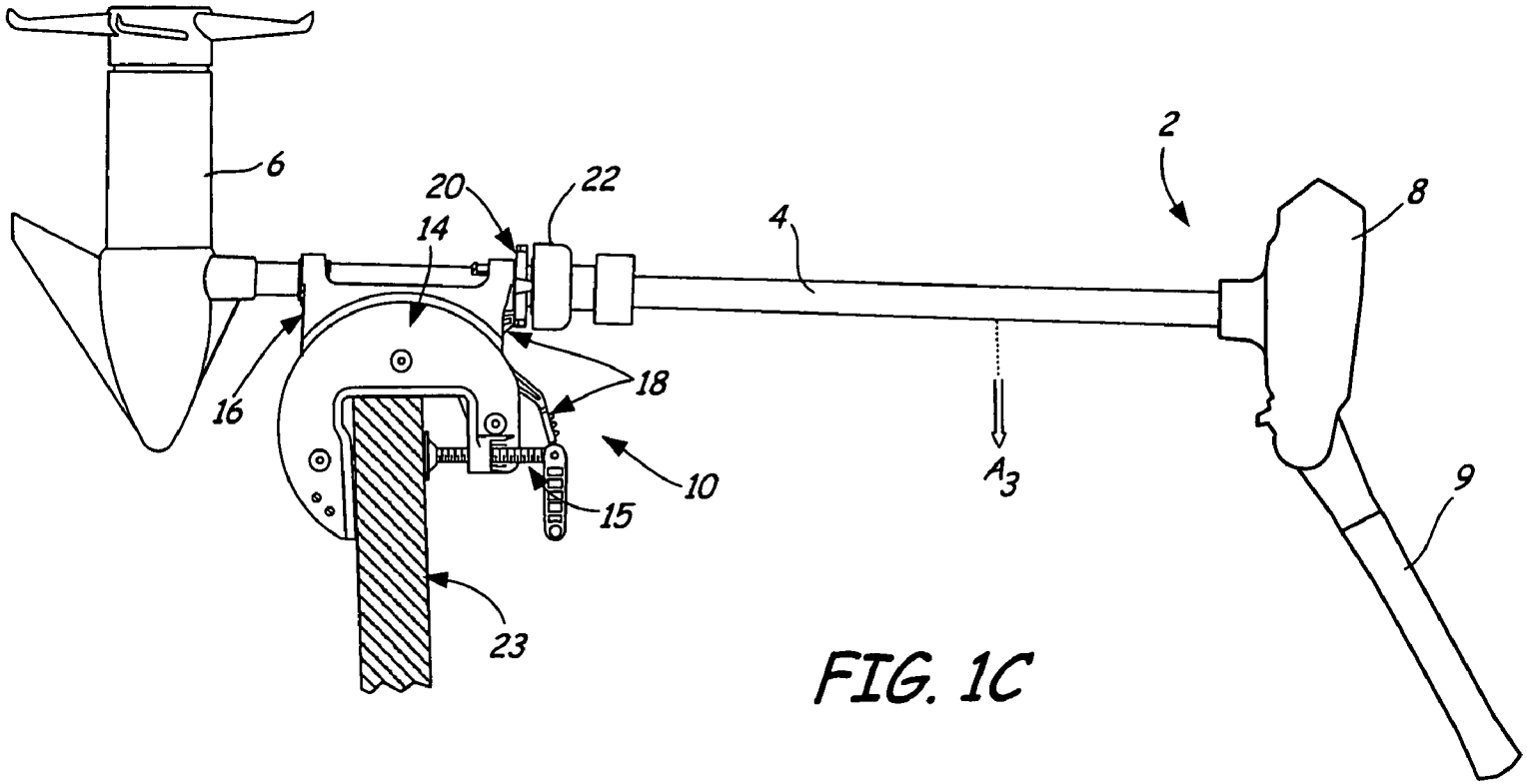
FIG. 1C is a side view of the bracket assembly and trolling motor of FIG. 1A shown in the stowed position and illustrating a final stowing actuation by the operator.
Figure 1D:
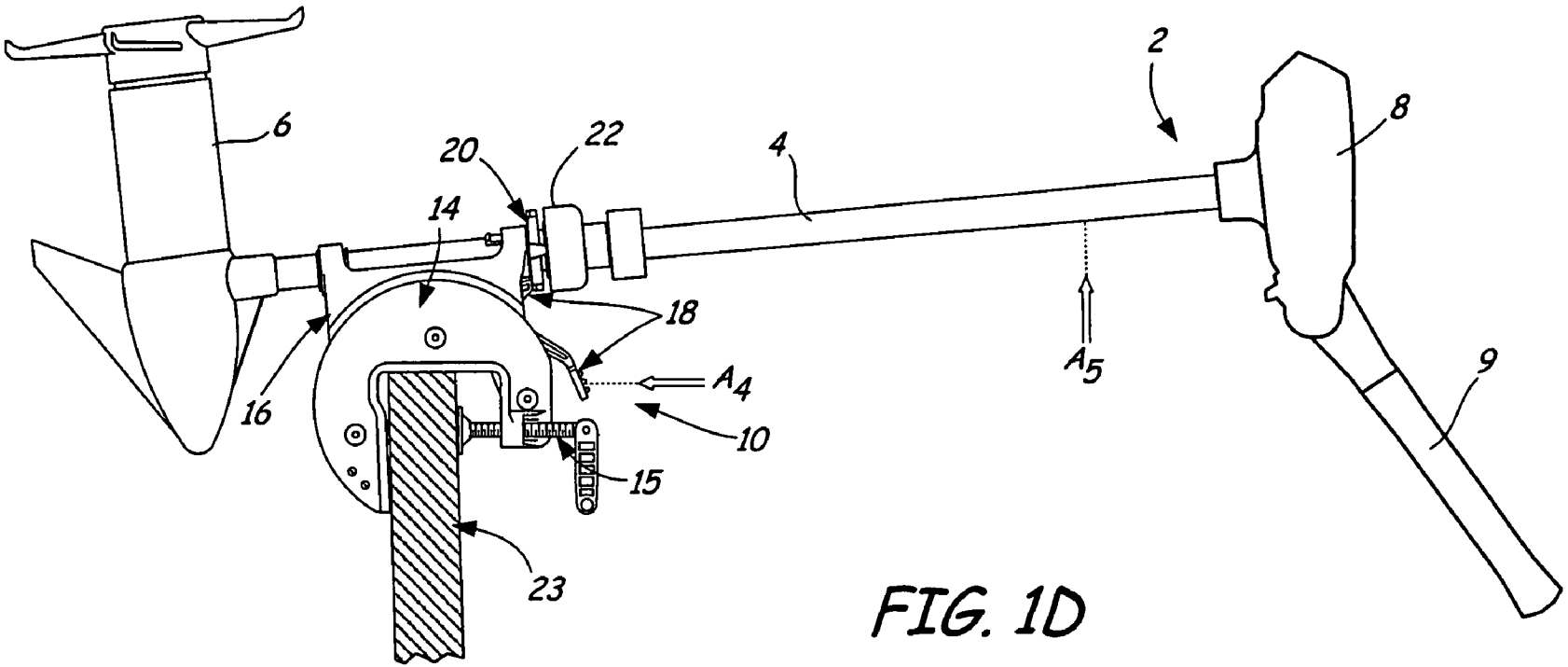
FIG. 1D is a side view of the bracket assembly and trolling motor of FIG. 1A shown in the stowed position and illustrating a deploying actuation by the operator.

FIGS. 1A to 1D are side views of a bracket assembly 10 retaining a trolling motor 2 in multiple tilt positions including a deployed position (shown in FIG. 1A), and a stowed position (shown in FIG. 1C and FIG. 1D). The trolling motor 2 includes a shaft 4, a drive unit 6, a head assembly 8, and a handle 9. The bracket assembly 10 includes a bracket 14, screw clamps 15, a coupling hinge 16, a lift arm 18, a collet 20, and a resistance knob 22.

The bracket 14 includes corresponding interfacing interconnected portions which have inner lower portions adapted to mount on a transom or gunnel 23 of a watercraft. The screw clamps 15 secure the bracket 14 to the transom or gunnel 23. The upper outer portions of the bracket 14 are spaced apart to receive a portion of the coupling hinge 16 therebetween. The coupling hinge 16 receives and rotatably retains the trolling motor 2. A portion of the lift arm 18 is also disposed between the outer spaced apart portions of the bracket 14 and is pivotally coupled to the coupling hinge 16. The collet 20 seats in the coupling hinge 16 and receives the shaft of the trolling motor 2. The resistance knob 22 selectively interconnects about the collet 20 and receives the shaft of the trolling motor 2.

The upper outer portions of the bracket 14 are spaced apart to receive portions of the coupling hinge 16 and lift arm 18. The coupling hinge 16 and lift arm 18 are movable between the portions of the bracket 14. The coupling hinge 16 moves between the portions of the bracket 14 to move the trolling motor 2 to multiple tilt angle positions with respect to the bracket 14. The lift arm 18 may be used to selectively lock the coupling hinge 16 to the bracket 14 in various tilt angle positions. The resistance knob 22 selectively threads onto the collet 20 to tighten or loosen the collet 20 about the shaft of the trolling motor 2. The selective interaction of the resistance knob 22 and collet 20 adjusts the amount of force required by operator to steer the trolling motor 2.

The multiple tilt angle positions include the deployed position shown in FIG. 1A. In the deployed operating position, the trolling motor 2 extends generally vertically adjacent the outboard side of the transom into the water. Generally, the motor shaft 4 and drive unit 6 of the trolling motor 2 enter the water when the trolling motor 2 is in the deployed position. The head 8 of the trolling motor 2 is connected to the shaft 4 such that it is disposed above the bracket 14 when the trolling motor 2 is in the deployed position. The handle 9 projects from the head 8 generally toward the operator. The handle 9 can be tiltable upward and downward of a generally horizontal angle with respect to the head 8. This allows the handle 9 to be adjusted to the operator's preference. Several other tilt angle positions allow motor shaft 4 and/or drive unit 6 of the trolling motor 2 to remain in the water with a shallower draft than the draft associated with the generally vertical deployed position. In the nonuse stowed position shown in FIG. 1C, the trolling motor 2 extends generally horizontally with respect to the transom or deck of the watercraft. This position disposes the head 8 and tiltable handle 9 generally inboard of the transom or gunnel 23 within easy reach of the operator. FIG. 1B shows a tilt angle position between the deployed position of FIG. 1A and the stowed position shown in FIG. 1C.

The coupling hinge 16 receives and retains the trolling motor 2. Generally, the bracket assembly 10 is configured such that movement or tilt of the trolling motor 2 by the operator also moves the coupling hinge 16 when the lift arm 18 is disengaged from a locking position with the bracket 14. FIGS. 1A to 1D demonstrate the stowing or deploying actuation by the operator which disengages the lift arm 18. This actuation also moves the trolling motor 2 and coupling hinge 16 from the deployed position to the stowed position or visa versa. FIGS. 1A to 1D merely demonstrate the actuations used for one embodiment of the bracket assembly 10 and trolling motor 2, other embodiments of the assembly 10 may have different actuation means or may have a different actuation direction(s) than those illustrated.

In FIG. 1A, the operator grasps the shaft 4, head 8, or handle 9 with one or both hands and actuates $A_1$ the trolling motor 2 generally upward. This actuation $A_1$ moves the trolling motor 2, collet 20, and knob 22 with respect to the coupling hinge 16. As a result of the actuation $A_1$, the collet 20 is lifted off the lift arm 18 disengaging it from the bracket 14. This action frees the coupling hinge 16 to tilt and move with respect to the bracket 14.

The operator then continues the stowing actuation $A_2$ of the coupling hinge 16 and trolling motor 2 as shown in FIG. 1B. More particularly, the operator grasps a portion of the trolling motor 2 with one or both hands and actuates $A_2$ movement by pulling generally horizontally inward toward his or her self.

FIG. 1C shows the final stages of stowing when the trolling motor 2 and coupling hinge 16 have reached or almost reached the stowed position. At this point stowing actuation $A_3$ by the operator is in a generally downward direction. Actuation $A_3$ by the operator ceases once the lift arm 18 is locked into the stowed position. This locks the coupling hinge 16 and trolling motor 2 in the stowed position.

FIG. 1D illustrates the beginning stages of the deploying the trolling motor 2 from the stowed position. In one embodiment, the operator begins deploying the trolling motor 2 by depressing $A_4$ the lift arm 18 inward toward the bracket 14. The operator then actuates $A_5$ movement of the trolling motor 2 by grasping a portion of the trolling motor 2 and pulling the trolling motor 2 generally upward and then pushing the motor 2 generally horizontally away from his or her self. In one embodiment, the operator must continue depressing $A_4$ the lift arm 18 during the entire portion of actuation $A_5$. As a result of the deploying actuations $A_4$ and $A_5$, the trolling motor 2 extends generally vertically adjacent the outboard side of the transom into the water and the lift arm 18 locks the trolling motor 2 and coupling hinge 16 into the deployed position with respect to the bracket 14. Actuations $A_2$ or $A_5$ can cease between the stowed position and the deployed position. This allows the coupling hinge 16 and the trolling motor 2 to be locked in multiple tilt angle positions along the bracket 14.

The movement of the coupling hinge 16 between the mounted portions of the bracket 14 to multiple tilt angle positions (including the stowed position) allows for quick, smooth and convenient stowage of the trolling motor 2 by the operator without having to actuate or unlock any pins or other locking devices. For example, if the watercraft enters shallow water where the motor shaft or drive unit of the trolling motor 2 may contact underwater obstructions, the configuration of the lift arm 18, coupling hinge 16, and bracket 14 allows the operator to quickly tilt and/or stow the trolling motor 2 simply by pulling inward on the trolling motor tiller handle or motor shaft. Likewise, the configuration of the lift arm 18, coupling hinge 16, and bracket 14 allows the operator to stow the trolling motor 2 after motor operation has ceased by simply pulling upward and inward on portion(s) of the trolling motor 2 rather than having to manually actuate or unlock a locking mechanism before stowing (and during the stowing of) the trolling motor 2.

Figure 2:
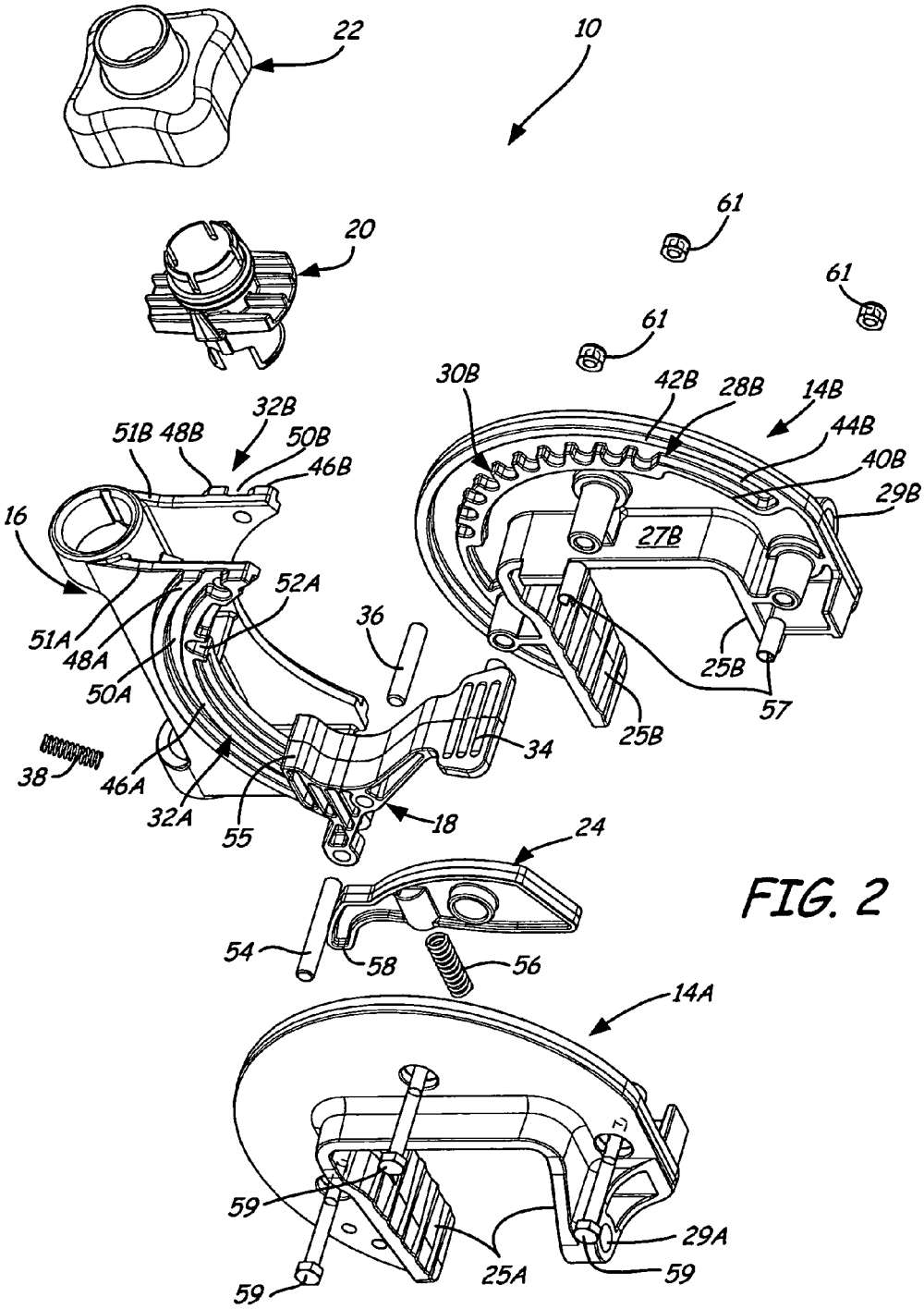
FIG. 2 is an exploded view of the bracket assembly.

FIG. 2 shows an exploded view of the bracket assembly 10. In addition to the components discussed previously, the bracket assembly 10 includes a cam mechanism 24, a pivot pin 36, a first bias spring 38, alignment bushings 57, thru bolts 59, and nuts 61. The bracket 14 includes corresponding features common to both left and right brackets 14A and 14B. The left and right brackets 14A and 14B include left and right clamp members 25A and 25B, tubular cross members 26, left and right platforms 27A and 27B, left and right male and female surface profiles 28A and 28B, threaded holes 29A and 29B, and detents 30A and 30B. The coupling hinge 16 includes left and right male and female surface profiles 32A and 32B. The lift arm 18 includes a handle 34, a locking pin 54 and a nose 55. The male and female surface profile 28B of the bracket 14B includes an inner rib 40B, an outer rib 42B, and a channel 44B. The male and female surface profiles 32A and 32B of the coupling hinge 16 include an inner rib 46A and 46B, a guide rib 48A and 48B, and a channel 50A and 50B. The male and female surface profiles 32A and 32B are disposed on left and right spaced apart surfaces 51A and 51B which have notches 52A and 52B therein. The cam mechanism 24 includes a second bias spring 56 and a nose 58.

Figure 3:
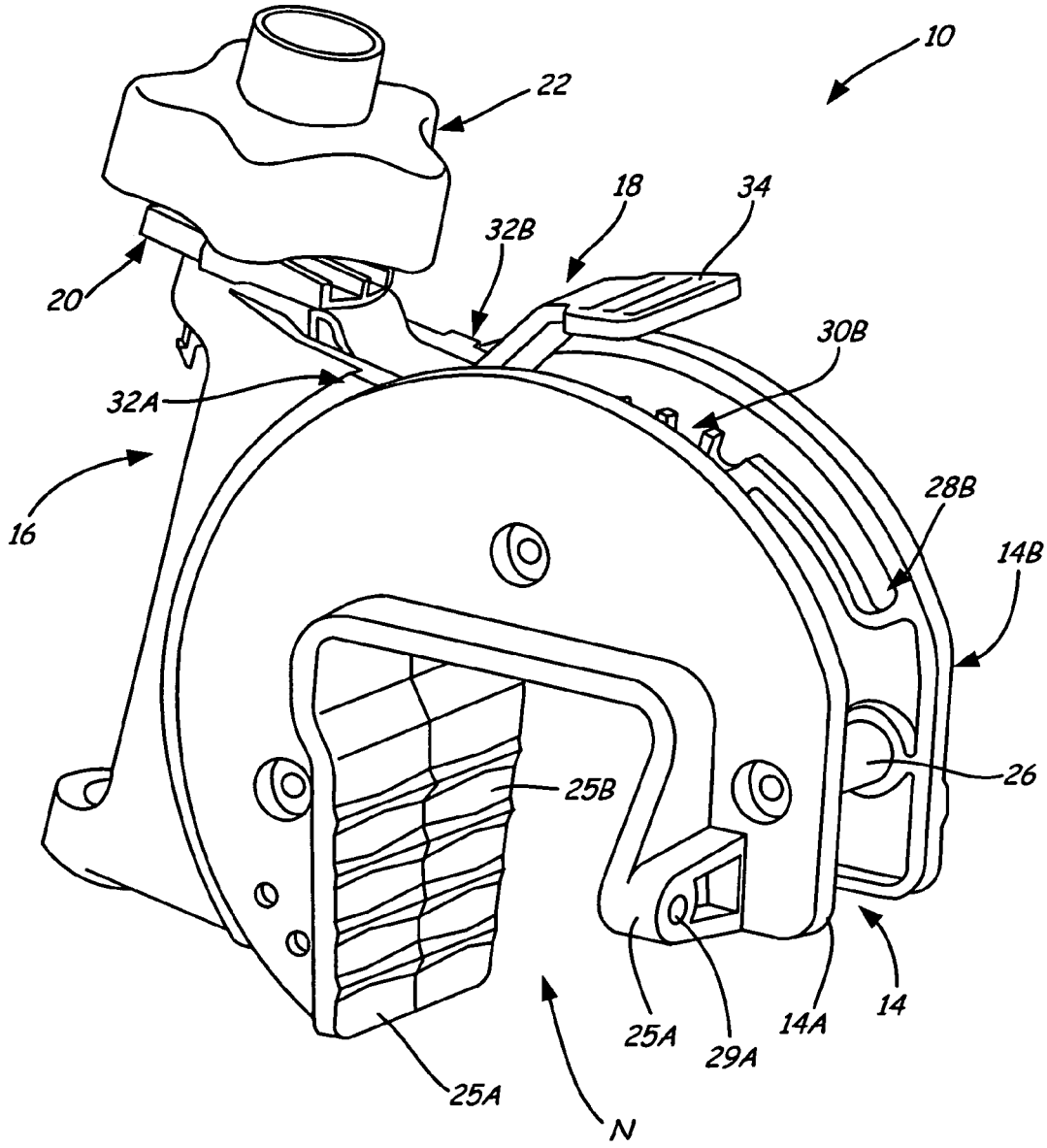
FIG. 3 is an elevated perspective view of the bracket assembly of FIG. 1A.
Figure 3A:
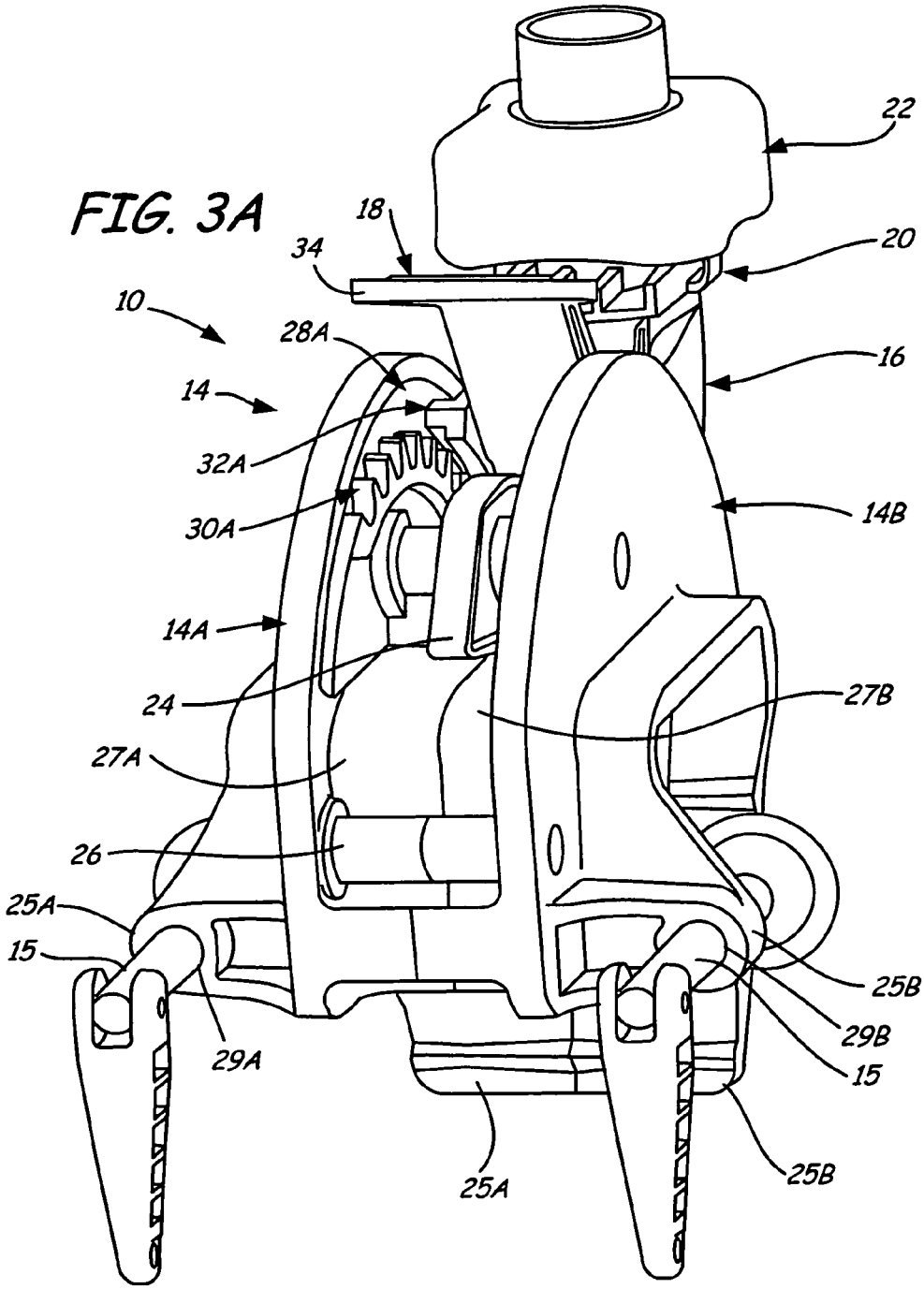
FIG. 3A is an elevated perspective view of the right rear of the bracket assembly.
Figure 3B:
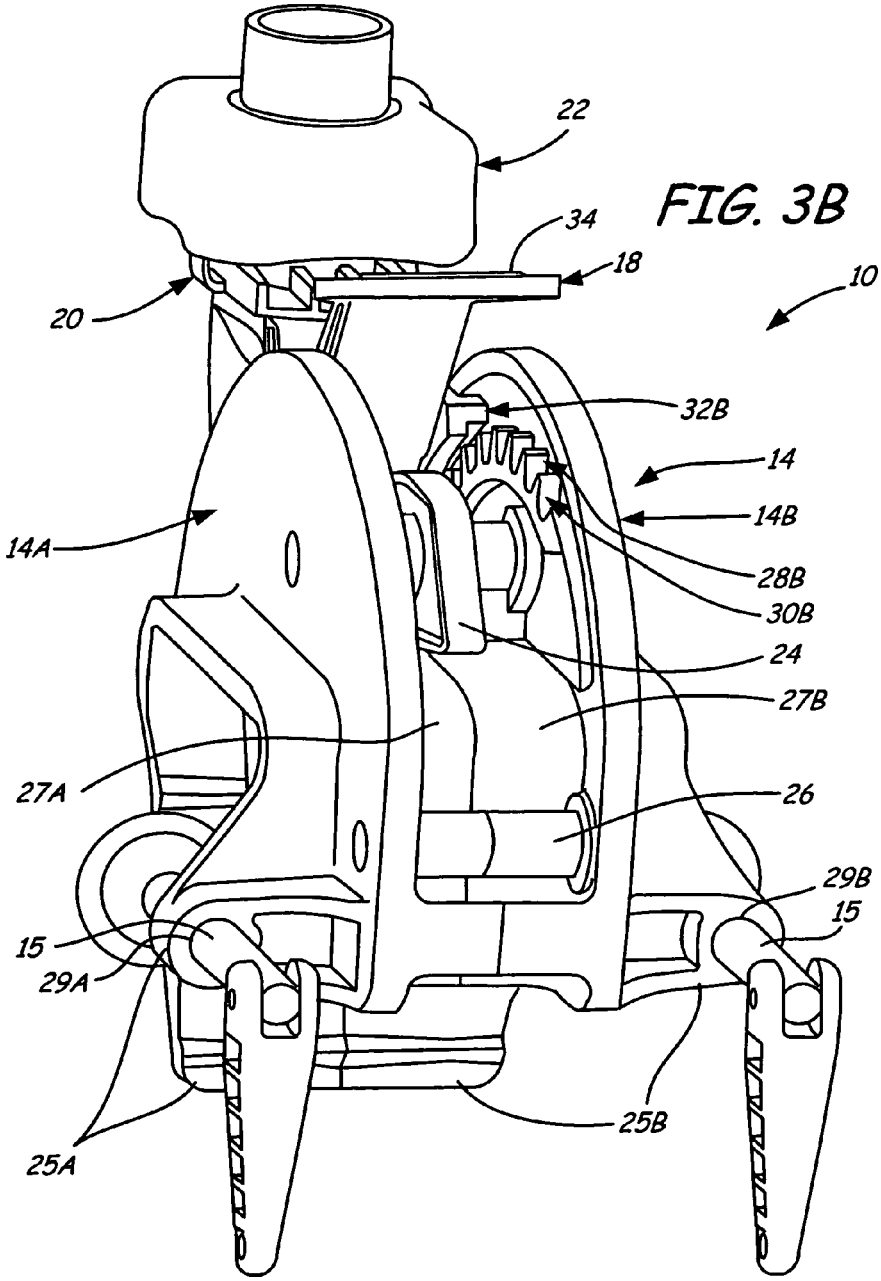
FIG. 3B is an elevated perspective view of the left rear of the bracket assembly.

FIG. 3 shows an elevated perspective view of the bracket assembly 10. FIGS. 3A and 3B show elevated rear views of the bracket assembly 10. Together FIGS. 3, 3A, and 3B provide an overview of some of the components and features of the bracket assembly 10.

The left and right clamp members 25A and 25B, disposed at the lower portion of each bracket 14A and 14B, interconnect with each other and are configured to form a notch N through the brackets 14A and 14B. The notch N formed by the interconnected clamp members 25A and 25B receives the lip of the gunnel or transom. Each clamp member 25A and 25B has a threaded hole 29A or 29B therethrough. The treaded holes 29A and 29B receive a threaded portion of one of the screw clamps 15. The threads allow the screw clamps 15 to be adjusted in the holes 29A and 29B to secure the clamp member 25A and 25B against the transom or gunnel.

The outer upper portions of the brackets 14A and 14B are spaced apart and interconnected by the tubular cross members 26 which receive fasteners (FIGS. 1A-1D) and can also receive alignment bushings 57. The exterior facing portions of the tubular cross members 26 can be counter sunk to receive the head of a thru bolt 59 and nut 61 therein. The lower portions of the brackets 14A and 14B include the platforms 27A and 27B which extend inward to abut one another. A portion of the cam mechanism 24 rests on the right platform 27B such that the cam mechanism 24 is disposed between the brackets 14A and 14B. The cam mechanism 24 is rotatably coupled to one of the tubular cross members 26 and contacts a portion of the lift arm 18.

The upper interfacing portions of the brackets 14A and 14B have corresponding left and right male and female surface profiles 28A and 28B, respectively. In one embodiment, the brackets 14A and 14B are generally C-shaped such that the male and female surface profiles 28A and 28B extend in an arc adjacent the upper outer edge of each bracket 14A and 14B. Thus, when the brackets 14A and 14B are mounted, the male and female surface profiles 28A and 28B are disposed over the transom or the gunnel of the watercraft from adjacent an inboard side of the transom or gunnel to adjacent an outboard side of the transom or gunnel. The male and female surface profiles 28A and 28B of the brackets 14A and 14B are staggered with respect to the left and right male and female surface profiles 32A and 32B of the coupling hinge 16 when the coupling hinge 16 is assembled between the brackets 14A and 14B. This staggered disposition slidably interleaves the male and female surface profiles 32A and 32B of the coupling hinge 16 with the male and female surface profiles 28A and 28B of the brackets 14A and 14B. The brackets 14A and 14B and the coupling hinge 16 need not have both male and female surface profiles, for example, the coupling hinge 16 may be configured with only a male surface profile and the brackets 14A and 14B with only a corresponding female profile, or visa versa.

The left and right detents 30A and 30B are arrayed arcuately adjacent the outer edge of the brackets 14A and 14B, inward from the male and female surface profiles 28A and 28B. The left array of detents 30A corresponds to and interfaces with right array of detents 30B. The detents 30A and 30B are selectively engaged by the lift arm 18. The handle 34 portion of the lift arm 18 extends outward from between the outer edge of the brackets 14A and 14B.

The left and right clamp members 25A and 25B receive the lip of the gunnel or transom to mount (FIGS. 1A to 1D) the bracket assembly 10 thereon. The platforms 27A and 27B form an interconnected surface that the cam mechanism 24 rotatably rests against. The male and female surface profiles 32A and 32B of the coupling hinge 16 are interleaved with the male and female surface profiles 28A and 28B of the brackets 14A and 14B to form a track and track follower. The track allows the coupling hinge 16 to slide with respect to the brackets 14A and 14B along the track to move the trolling motor between the stowed position and the deployed position.

The detents 30A and 30B define multiple tilt angle positions for the coupling hinge 16 and trolling motor 2 with respect to the brackets 14A and 14B. The lift arm 18 is pivotally coupled to the coupling hinge 16 and is configured to releasably engage the detents 30A and 30B to lock the coupling hinge 16 in the multiple tilt angle positions. More particularly, the handle 32 of the lift arm 18 projects outward from between the outer edge of the brackets 14A and 14B to more easily allow the operator to actuate the lift arm 18 out of engagement with the detents 30A and 30B.

Figure 4:
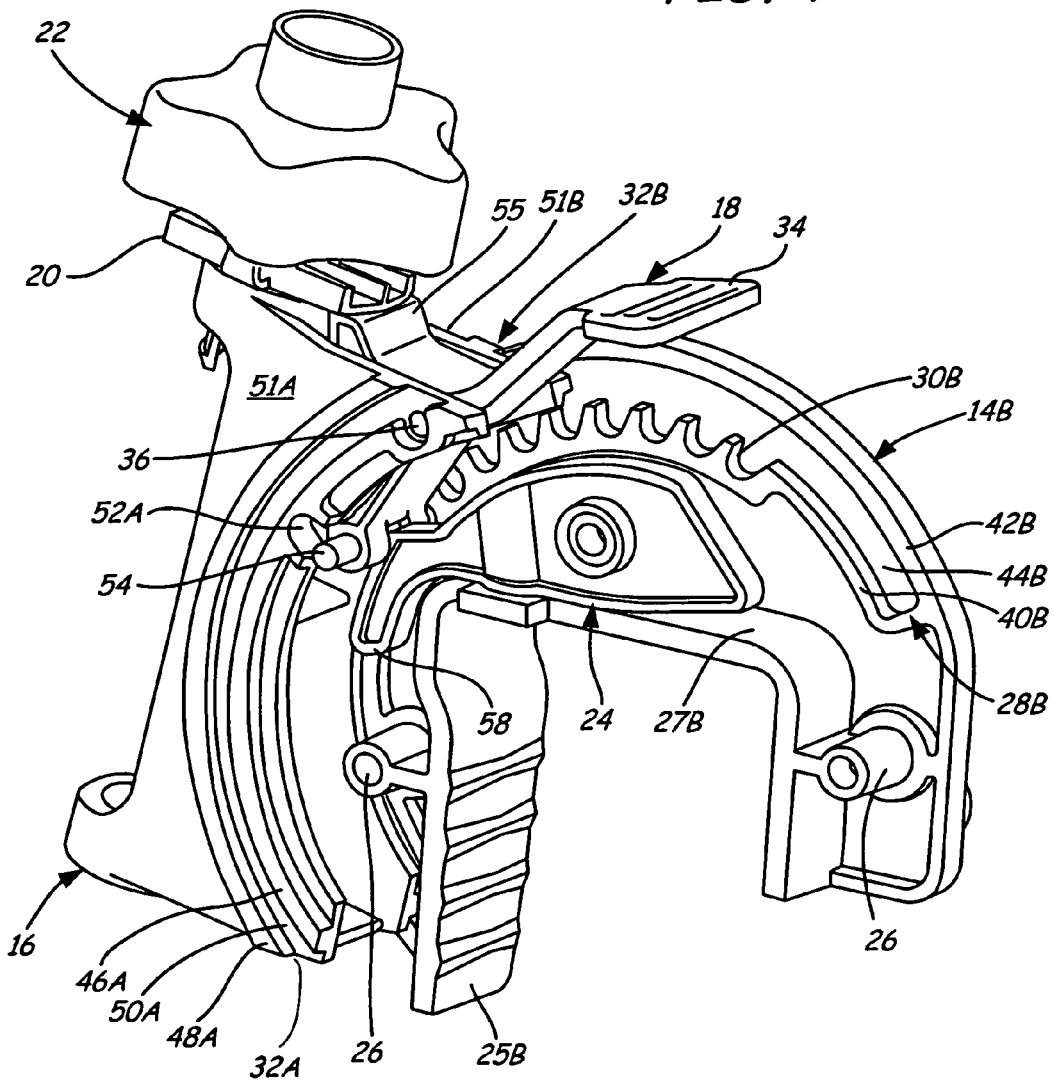
FIG. 4 is an elevated perspective view of the bracket assembly of FIG. 1A with a portion of the bracket removed to show additional components of the bracket assembly.

FIG. 4 shows the bracket assembly 10 with the left bracket 14A removed. FIGS. 4A-4D show a side view of the right bracket 14B with the lift arm 18, the coupling hinge 16, and the cam mechanism 24 in phantom and disposed in multiple tilt angle positions. FIGS. 4 and 4A-4D provide a further detailed explanation of the components and operation of the bracket assembly 10.

In FIGS. 4 and 4A-4D, the left bracket 14A has been removed to better illustrate the features and components of the bracket assembly 10. The left bracket 14A has features corresponding to those of the right bracket 14B including an inner rib 40A, an outer rib 42A, and a channel 44A. The coupling hinge 16 is adapted with interfacing left and right spaced apart surfaces 51A and 51B which receive a portion of the lift arm 18 therebetween. More particularly, the pivot pin 36 is received in both the left and right spaced apart surfaces 51A and 51B of coupling hinge 16 and extends through the lift arm 18 to pivotally couple the lift arm 18 to the coupling hinge 16. In FIGS. 4A-4D, a portion of the coupling hinge 16 is sectioned and shown in phantom allowing the viewer to see the first bias spring 38 disposed between the outboard facing surface of the lift arm 18 and the inboard facing surface of the coupling hinge 16 below the collet 20.

The inner rib 40B extends arcuately along a portion of the right bracket 14B adjacent the bracket's 14B outer edge. The inner rib 40B interconnects with the outer rib 42B and the detents 30B. The outer rib 42B extends arcuately generally parallel to the inner rib 40B along the upper outer edge of the bracket 14B and interconnects with the inner rib 40B at the upper inboard and lower outboard portions of the bracket 14B. The channel 44B extends generally arcuately between the inner rib 40B and the outer rib 42B and between the outer rib 42B and the detents 30B.

The inner rib 46A and 46B extends along the exterior of the left and right spaced apart surfaces 51A and 51B of the coupling hinge 16. The inner rib 46A is disposed to interface the bracket 14A (FIGS. 3A and 3B) and the inner rib 46B is disposed to interface the bracket 14B. Focusing on the left spaced apart surface 51A of the coupling hinge 16, the inner rib 46A extends arcuately between the upper and lower edges of the coupling hinge 16. The guide rib 48A extends arcuately between the upper and lower edges of the coupling hinge 16. The guide rib 48A extends generally parallel to the inner rib 46A along the outboard portion of the coupling hinge 16 from the inner rib 46A. The channel 50A extends generally arcuately between the inner rib 46A and the guide rib 48A. The inner rib 46B, guide rib 48B, and channel 50B are similarly disposed on the right spaced apart surface 51B of the coupling hinge 16.

The inner rib 46A and 46B, the guide rib 48A and 48B, and the channel 50A and 50B are staggered with respect to the inner rib 40A and 40B, the outer rib 42A and 42B, and the channel 44A and 44B when the coupling hinge 16 is slidably assembled on the brackets 14A (FIGS. 3A and 3B) and 14B. In one embodiment, this staggered disposition interleaves these features such that the inner rib 46B extends into the channel 44B, the outer rib 42B extends into the channel 50B, the guide rib 48B extends along the outer rib 42B at the edge of the bracket 14B, and the inner rib 40B extends along the inner rib 46B. The disposition of the corresponding "A" features would be similar when the coupling hinge 16 is assembled on the right bracket 14A (FIGS. 3A and 3B).

The notches 52A and 52B extend into the left and right spaced apart surfaces 51A and 51B from the inboard facing edge of the coupling hinge 16. Each notch 52A and 52B is disposed to selectively receive the locking pin 54 extending from the lift arm 18 when the handle 34 of the lift arm 18 is actuated by the operator to overcome the bias of the first bias spring 38. The locking pin 54 extends between the left and right brackets 14A (FIGS. 3-3B) and 14B to selectively engage the detents 30A and 30B. The nose 55 of the lift arm 18 selectively engages the collet 20.

The second bias spring 56 extends within the cam mechanism 24 and contacts both the cam mechanism 24 and the right platform 27B. In FIGS. 4A-4D, the second bias spring 56 biases the nose 58 projection on the outboard facing portion of the cam mechanism 24 rotatably upward between a portion of the detents 30A and 30B. In one embodiment, the nose 58 is biased to extend between the lowest three detents 30A and 30B such that the locking pin 54 does not engage the lowest three detents. For example, when the coupling hinge 16 is in the stowed position as shown in FIG. 4D, the nose 58 is biased to extend between the lowest three detents 30A and 30B.

The locking pin 54 is biased into locking engagement with the detents 30A and 30B by the first bias spring 38. The bias exerted by the first bias spring 38 may be overcome manually by the operator actuating the lift arm 18 or in some instances by the combination of the operator manually actuating the trolling motor 2 upward and inward with one hand while the second bias spring 56 exerts a disengaging bias force on the cam mechanism 24.

Figure 4A:
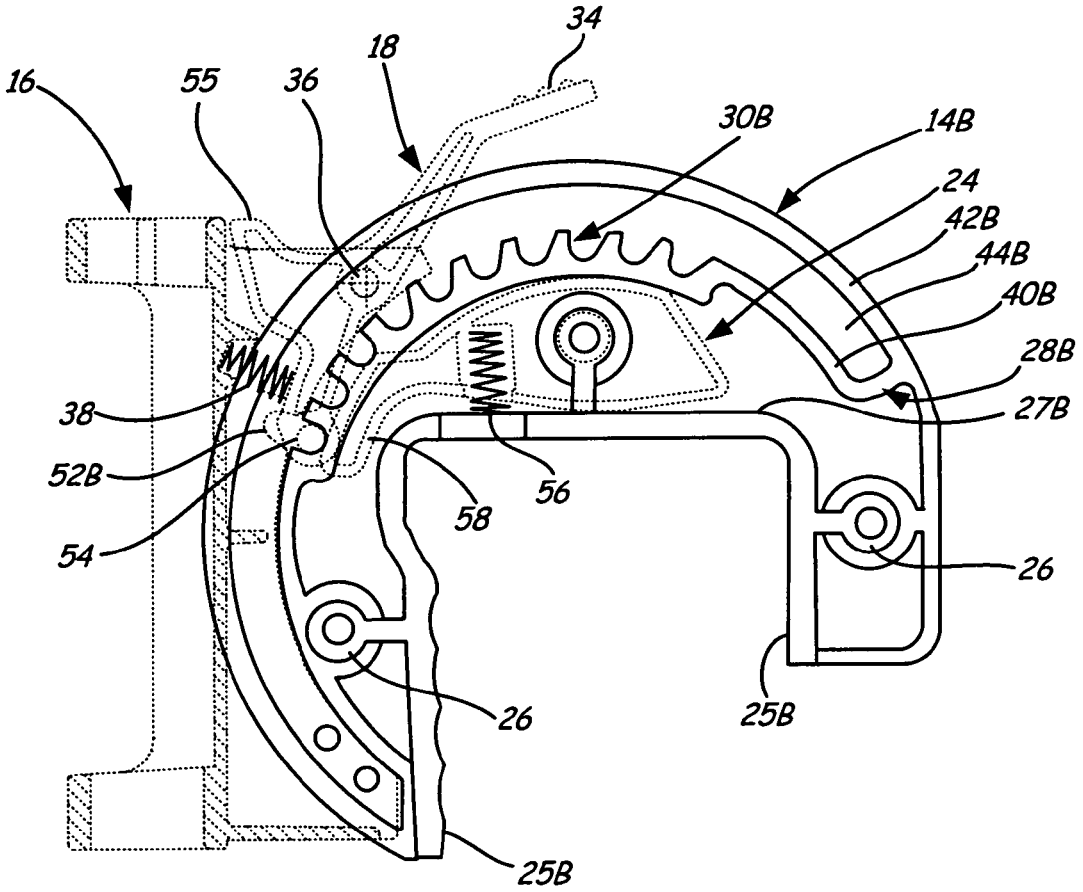
FIGS. 4A to 4D are a side views of the right portion of the bracket of FIG. 4 showing a lift arm, springs, a coupling hinge, and a cam mechanism in phantom.
Figure 4B:
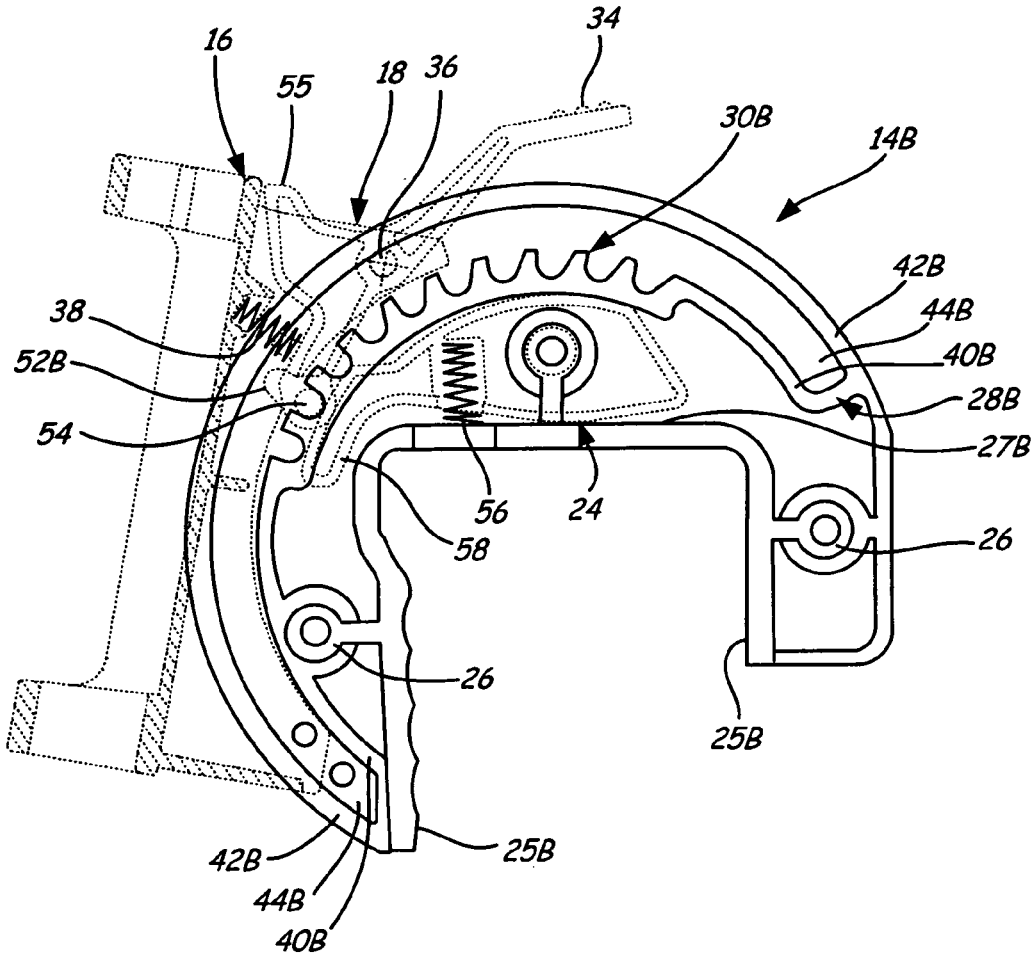
Figure 4C:
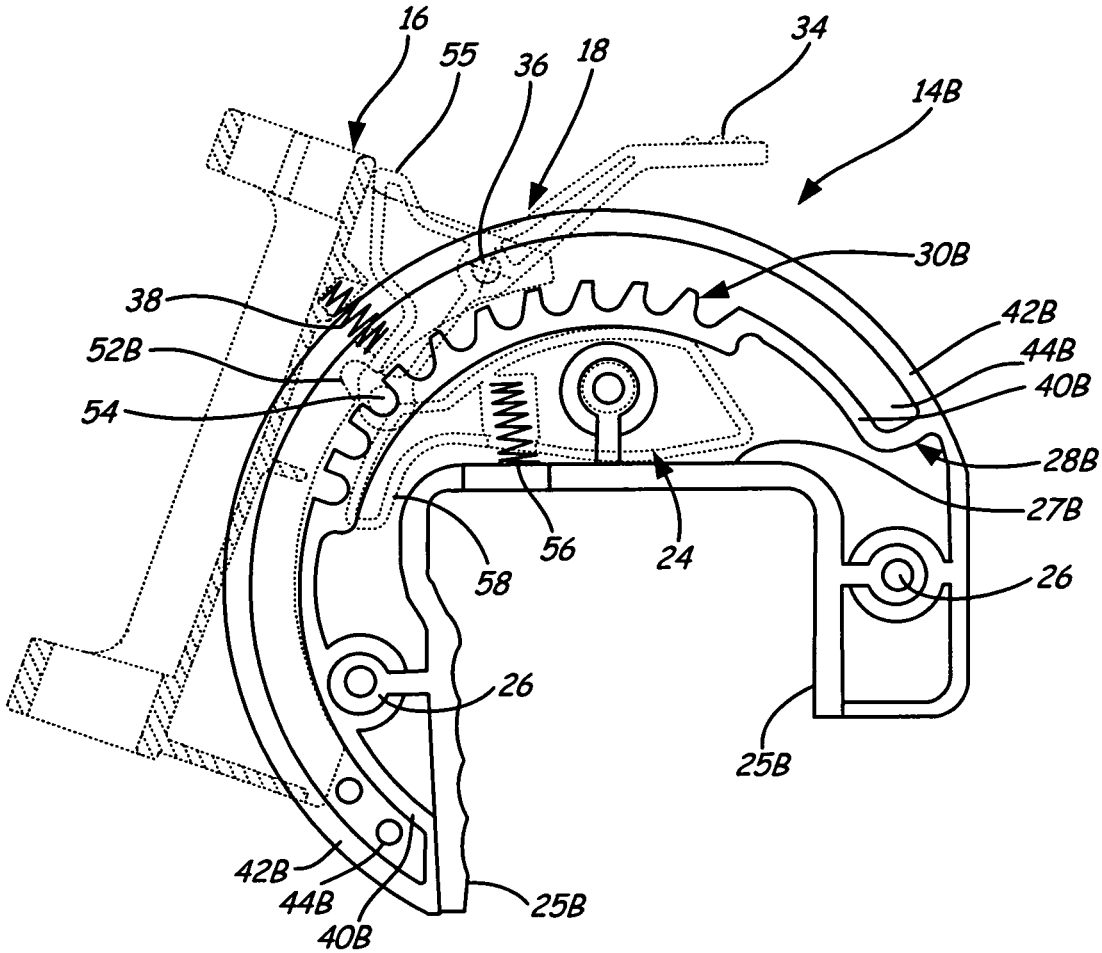
Figure 4D:
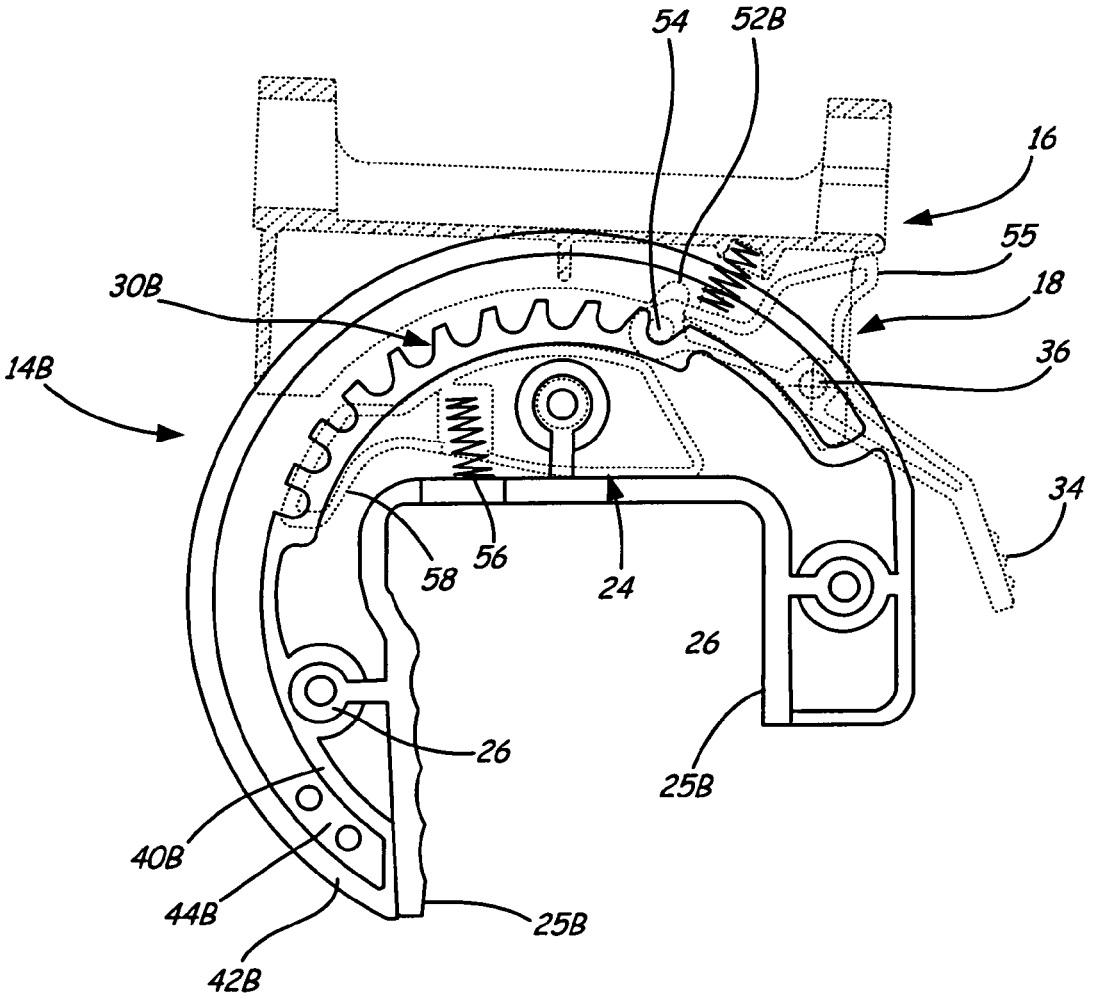

Regarding the second means by which the bias of the first spring 38 is overcome to unlock the locking pin 54 from the detents 30A and 30B, when the trolling motor is in a tilt angle position at or near the deployed position (for example as shown in FIGS. 4A to 4C), the trolling motor may be grasped manually by the operator and actuated upward and inward (toward the brackets 14A and 14B and the operator). By lifting the trolling motor 2 upward and tilting the trolling motor 2 inward and then downward, the weight of the trolling motor 2 on the locking pin 54 is eliminated or reduced to a sufficient extent such that the bias the second bias spring 56 exerts on the cam mechanism 24 rotates the nose 58 portion of the cam mechanism 24 upward between the detents 30A and 30B moving the locking pin 54. The nose 58 exerts sufficient force on the locking pin 54 and/or the lift arm 18 to overcome the engaging bias exerted by the first bias spring 34 on the locking pin 54. The nose 58 rotates the lift arm 18 sufficiently to disengage the locking pin 54 from the detents 30A and 30B.

Additionally, the pivot pin 36 which couples the lift arm 18 to the coupling hinge 16 allows the operator to actuate the lift arm 18 out of locking engagement with the detents 30A and 30B. More particularly, the handle 34 may be depressed downward by operator to overcome the bias exerted on the lift arm 18 by the first bias spring 38. The downward movement of the handle 34 rotates the locking pin 54 out of locking engagement with the detents 30A and 30B. During manual actuation, the nose 55 of the lift arm 18 contacts and raises the collet 20 and the first bias spring 38 is compressed by the lift arm 18 to allow the locking pin 54 to be received in the notches 52A and 52B in the coupling hinge 16. The locking pin 54 is received in the notch 52A and 52B such that the locking pin 54 does not engage the detents 30A and 30B.

In one embodiment, the detents 30A and 30B (FIGS. 3A and 3B) (or a portion of the detents 30A and 30B) may be configured as a ratchet and the locking pin 38 as a pawl. This configuration allows the coupling hinge 16 to be manually inclined upward toward the stowed position without the operator having to manually actuate the locking pin 54 out of engagement with the detents 30A and 30B via depressing the handle 34 of the lift arm 18. Thus, the locking pin 54 may remain in engagement with the detents 30A and 30B during the upward movement of the coupling hinge 16 and trolling motor. Instead this configuration allows the trolling motor 2, retained by the coupling hinge 16, to be manually actuated inward and downward by the operator (toward the brackets 14A and 14B and operator) to slide the coupling hinge 16 relative to the brackets 14A (FIGS. 3A and 3B) and 14B to move the trolling motor from the deployed position toward and to the stowed position. With the ratchet and pawl configuration discussed above, the lift arm 18 must still be manually actuated to overcome the bias of the first bias spring 38 on the locking pin 54 when the coupling hinge 16 is declined downward from the stowed position toward the deployed position.

The ratchet and pawl configuration is useful, for example, if the watercraft enters shallow water where the motor shaft or drive unit of the trolling motor may contact underwater obstructions. The configuration of the lift arm 18, coupling hinge 16, and brackets 14A and 14B allows the operator to quickly tilt and/or stow the trolling motor simply by pulling inward on the trolling motor tiller handle or motor shaft without having to manually actuate or unlock any pins or other locking devices.

Likewise, the staggered disposition of the inner rib 46A and 46B, the guide rib 48A and 48B, and the channel 50A and 50B of the coupling hinge 16 with respect to the inner rib 40A and 40B, the outer rib 42A and 42B, and the channel 44A and 44B of the brackets 14A (FIGS. 3-3B) and 14B interleaves these features. The interleaving of the ribs 40A and 40B, 42A and 42B, 46A and 46B, 48A and 48B and channels 44A and 44B and 50A and 50B allows the coupling hinge 16 to slide in an arcuate path along those features with respect to the brackets 14A and 14B to move the trolling motor between the stowed position and the deployed position. More specifically, the ribs and 40B, 42A and 42B, 46A and 46B, 48A and 48B and channels 44A and 44B and 50A and 50B allow the coupling hinge 16 to slide in an arc along the brackets 14A and 14B over the transom or the gunnel of the watercraft from adjacent an inboard side thereof to adjacent an outboard side when the bracket assembly 10 is mounted on the transom or gunnels. The interleaved ribs 40A and 40B, 42A and 42B, 46A and 46B, 48A and 48B and channels 44A and 44B and 50A and 50B allow for quick, smooth and convenient stowage of the trolling motor by the operator without the use of pivot pins or joints that may loosen or develop play over the operational life of the bracket assembly 10.

Figure 5:
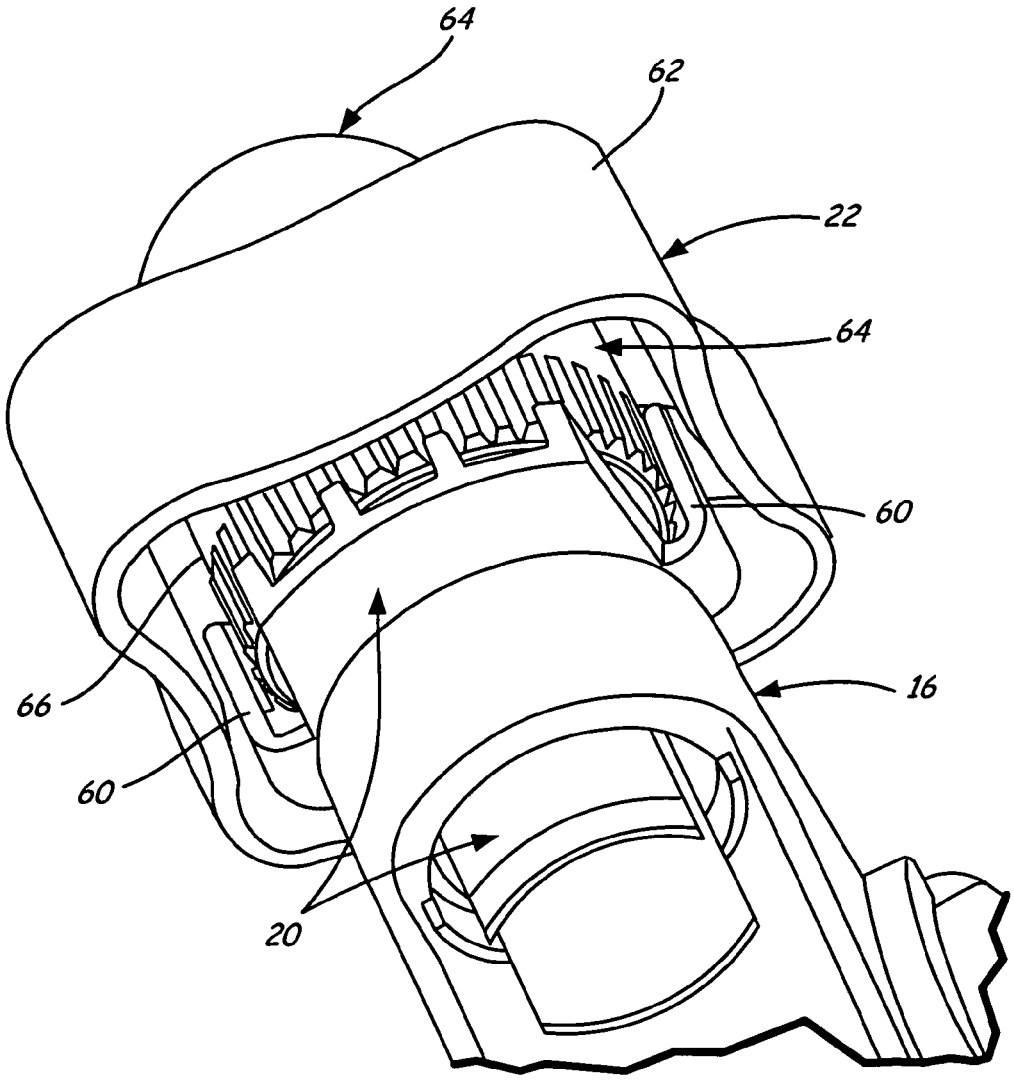
FIG. 5 is a perspective view of a portion of one embodiment of a resistance knob and a collet.

FIG. 5 shows the collet 20 and resistance knob 22 assembled on the coupling hinge 16. The collet 20 includes arm projections 60. The resistance knob 22 includes an outer shell 62, a receptacle 64, and detents 66.

The collet 20 is received in the coupling hinge 16 and seats thereabove. A portion of the collet 20 is received by the resistance knob 22. The arm projections 60 of the collet 20 project into and are disposed around a portion of the resistance knob 22. More specifically, the receptacle 64 of the resistance knob 22 receives the upper portion of the collet 20. The arm projections 60 project upward beneath the four lobed outer shell 62 of the resistance knob 22 and interface with the receptacle 64. In one embodiment, the receptacle 64 has detents 66 arrayed circumferentially therearound.

The detents 66 selectively engage the arm projections 60 to resist the rotation of the resistance knob 22 on the collet 20. This resistance helps to hold the collet 20 and resistance knob 22 against the shaft of the trolling motor and provides for incremental adjustment of the tension of the collet 20 and resistance knob 22 against the shaft. The resistance provided by the engagement of the detents 66 with the projection arms 60 also makes it difficult or impossible for the operator to freely spin the resistance knob 22 on or off the collet 20. This feature increases the durability of the resistance knob 22 and collet 20 and decreases the danger that the resistance knob 22 will be rapidly loosened to allow the trolling motor to slide through the collet 20 and coupling hinge 16 and contact objects below the transom or gunnel.

Figure 6A:
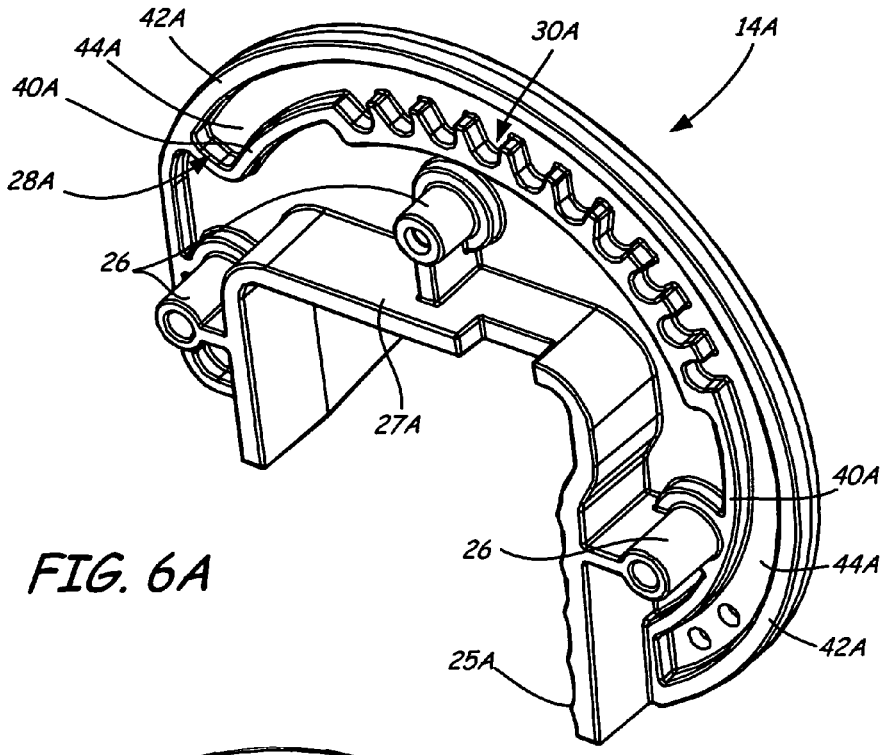
FIG. 6A is an elevated side perspective view of the left portion of one embodiment of the bracket.
Figure 6B:
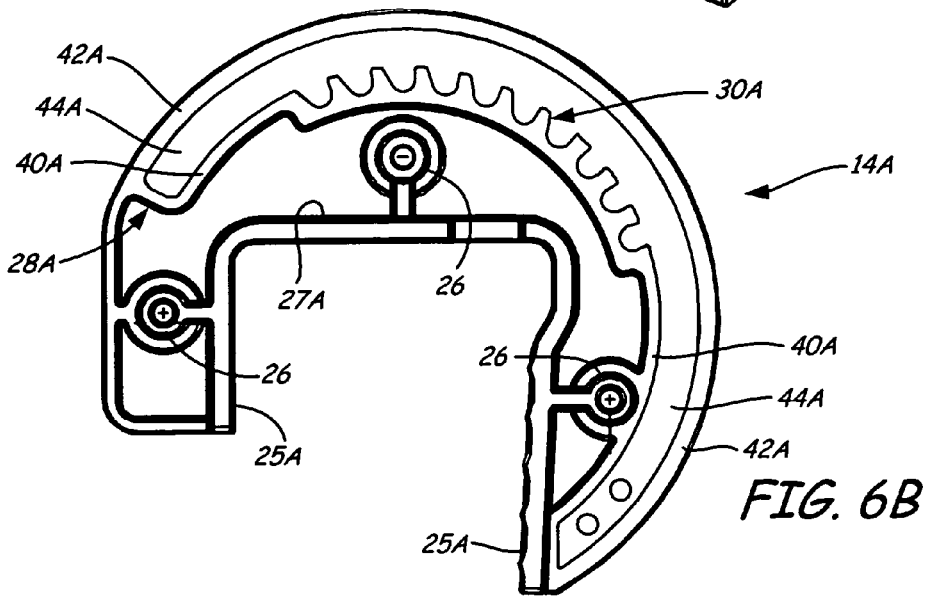
FIG. 6B is side view of the bracket of FIG. 6A.

FIGS. 6A and 6B show the left bracket 14A. The left bracket 14A is generally generally C-shaped with the clamp members 25A extending from the lower portions thereof. The tubular cross members 26 are arrayed along the left bracket 14A and receive fasteners (not shown) which interlock the left bracket 14A from the right bracket 14B (FIG. 4) at a predetermined distance. The left platform 27A extends along the interior lower portion of the left bracket 14A between the clamp members 25A. The detents 30A, inner rib 40A, outer rib 42A, and channel 44A extend arcuately adjacent an edge portion of the left bracket 14A from the upper inboard to the lower outboard portions thereof. The detents 30A extend co-extensive with the channel 44A and communicate therewith.

In one embodiment, the upper portion of the arcuate array of detents 30A and 30B (FIGS. 4 and 4A-4D) are configured as ratchets, however, the lower three detents 30A and 30B (defining tilt positions near and at the deployed position) are not configured as such. The nose 58 of cam mechanism 24 (FIG. 4A-4D) is disposed adjacent the lower three detents 30A (and corresponding lower three detents 30B). The configuration and disposition of the cam mechanism 24 allows it to be inter-imposed between the lower three detents 30A (and corresponding lower three detents 30B). Thus, when the motor is in a lowered tilt angle position at or near the deployed position, the nose 58 is configured to contact the locking pin 54 (FIGS. 4 and 4A-4C) to disengage the locking pin 54 from the detents 30A and 30B after the operator has pulled inward on the trolling motor.

Figure 7B:
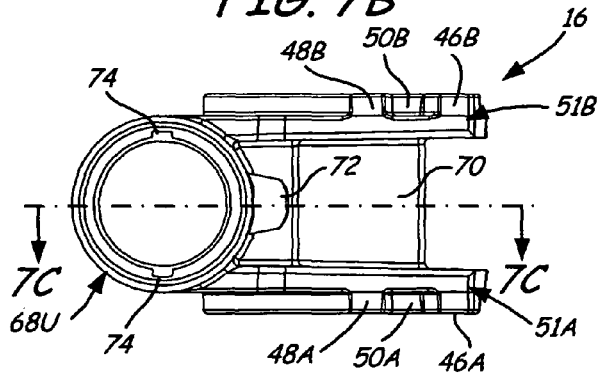
FIG. 7B is a top view of the coupling hinge of FIG. 7A.
Figure 7A:
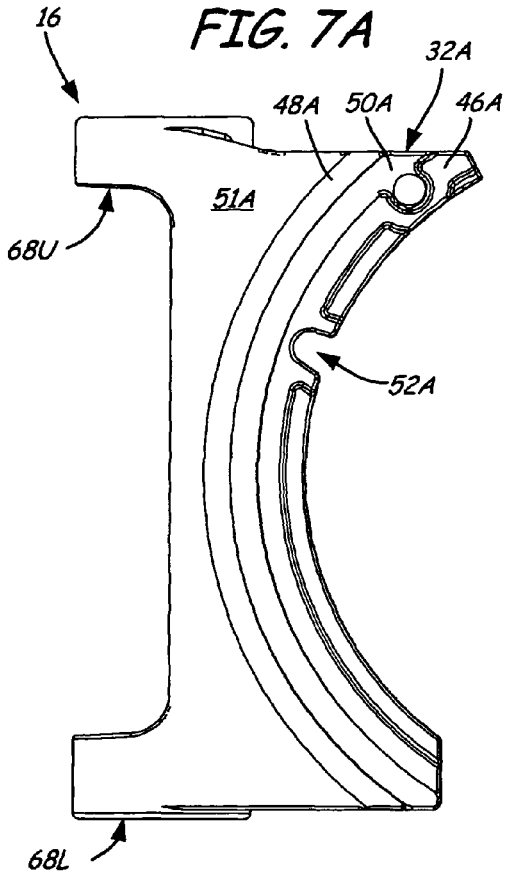
FIG. 7A is a side view of one embodiment of the coupling hinge.
Figure 7C:
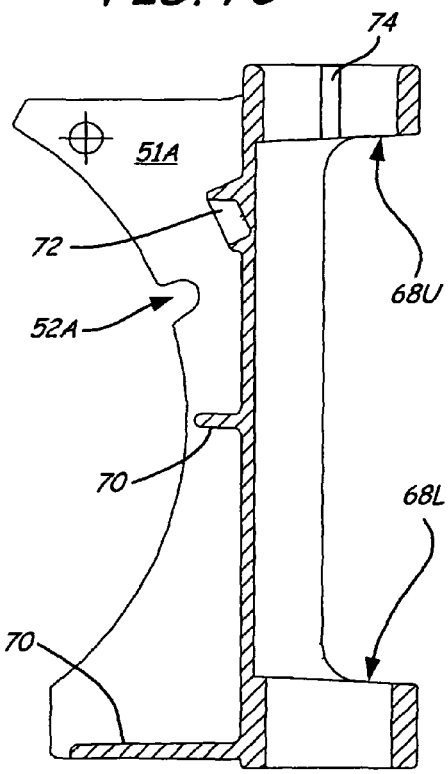
FIG. 7C is a side sectional view of the coupling hinge of FIG. 7B.

FIGS. 7A to 7C show the coupling hinge 16. In addition to the inner rib 46A and 46B, guide rib 48A and 48B, channel 50A and 50B, left and right spaced apart surfaces 51A and 51B, and notches 52A and 52B, the coupling hinge 16 includes an upper tubular projection 68U, a lower tubular projection 68L, cross members 70, and a pocket 72. The upper tubular projection 68U includes channels 74.

The inner rib 46A and 46B, guide rib 48A and 48B, channel 50A and 50B extend arcuately between the upper and lower edges of the left and right spaced apart surfaces 51A and 51B. The left and right spaced apart surfaces 51A and 51B interconnect with the tubular projections 68U and 68L which extend from the top to the bottom of the coupling hinge 16 between the surfaces 51A and 51B. The tubular projections 68U and 68L create an open frame therebetween which is capable of removably receiving and retaining the shaft 4 of the trolling motor 2. Because the tubular projections 68U and 68L are spaced apart to create the open frame, only the upper and lower portions of the coupling hinge 16 extend circumferentially around the shaft 4 of the trolling motor 2. The upper circumferential portion of the tubular projection 68U has channels 74 which interface with projections on the collet 20 (FIGS. 3-3B). In one embodiment, the lower circumferential portion of the tubular projection 68L may receive a hinge bushing (not shown) which interfaces with the shaft 4 of the trolling motor 2.

The cross members 70 interconnect and space apart the left and right spaced apart surfaces 51A and 51B. The pocket 72 is disposed on the inboard facing surface of the tubular projection 68 between the left and right spaced apart surfaces 51A and 51B. The pocket 72 receives the first bias spring 38 which is disposed between the outboard facing surface of the lift arm 18 and the coupling hinge 16 (FIGS. 4 and 4A-4D).

Figure 8A:
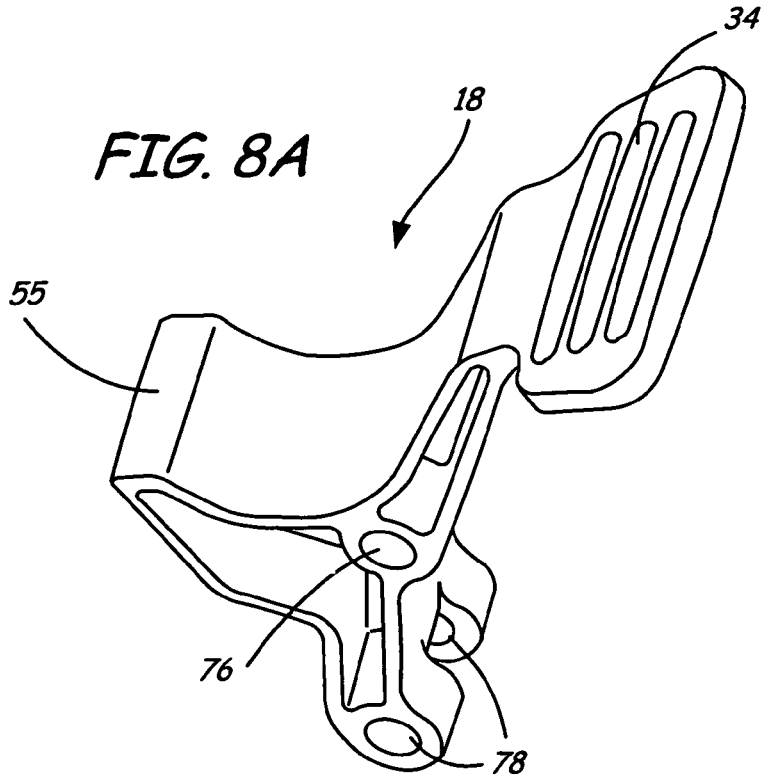
FIG. 8A is an elevated perspective view of one embodiment of the lift arm.
Figure 8B:
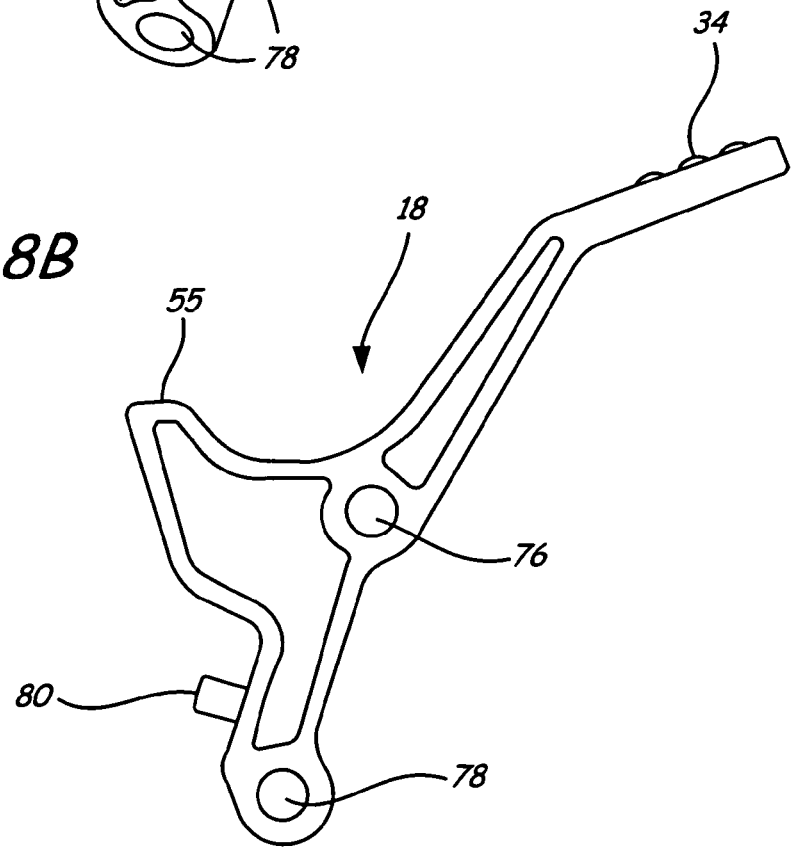
FIG. 8B is a side view of the lift arm of FIG. 8A.

FIGS. 8A and 8B show the lift arm 18. In addition to the handle 34 and nose 55, the lift arm 18 includes a first aperture 76, a second aperture 78, and a boss 80. The handle 34 extends outward from the main body of the lift arm 18. The first aperture 76 extends through the main body and receives the pivot pin 34 (FIG. 4) allowing the lift arm 18 to pivot about the pin 34. The second aperture 78 extends through a lower portion of the lift arm 18 and receives the locking pin 54. The boss 80 projects from a lower outboard facing surface of the lift arm 18. The boss 80 extends into and retains the first bias spring 38 (FIGS. 4A-4D). The nose 55 projects outward from the main body of the lift arm 18 and engages and raises the collet 20 when the handle 34 of the lift arm 18 is depressed by the operator.

Figure 9A:
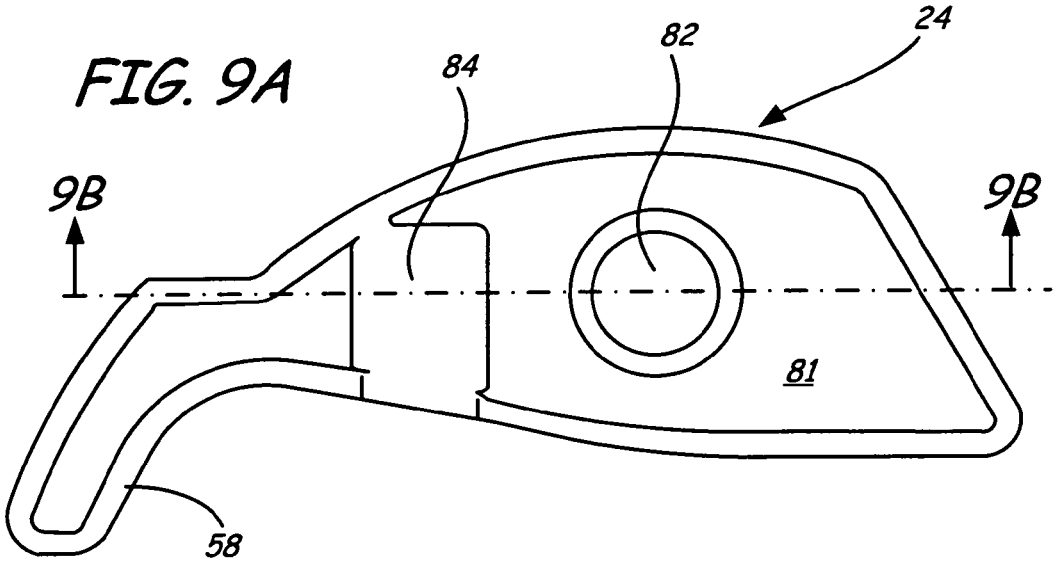
FIG. 9A is a side view of the cam mechanism.
Figure 9B:
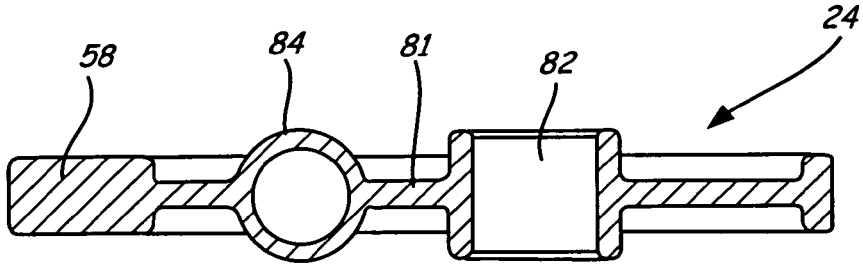
FIG. 9B is a sectional view of one embodiment of the cam mechanism of FIG. 9A.

FIGS. 9A and 9B show the cam mechanism 24. In addition to the nose 58, the cam mechanism 24 includes a main body 81, pivot aperture 82 and tubular member 84. The nose 58 extends downward and outward from the main body 81 of the cam mechanism 24. The pivot aperture 82 extends through the main body 81 of the cam mechanism 24 and receives one of the tubular cross members 26 (FIG. 4). The tubular member 84 extends generally upward into the cam mechanism 24 from the bottom edge thereof. The tubular member 84 defines a cavity which receives the second bias spring 56 (FIGS. 4A-4D). The second bias spring 56 contacts the upper portion of the tubular member 84 and extends from the tubular member 84 to contact the right platform 27B. The contact of the second bias spring 56 with the tubular member 84 and right platform 27B biases the cam mechanism 24 about the tubular cross member 26 received in the pivot aperture 82. The pivot action of the cam mechanism 24 as a result of the bias rotates the nose 58 of the cam mechanism 24 generally upward into the lift arm 18 and locking pin 54 (FIGS. 4A-4D).

Figure 10A:
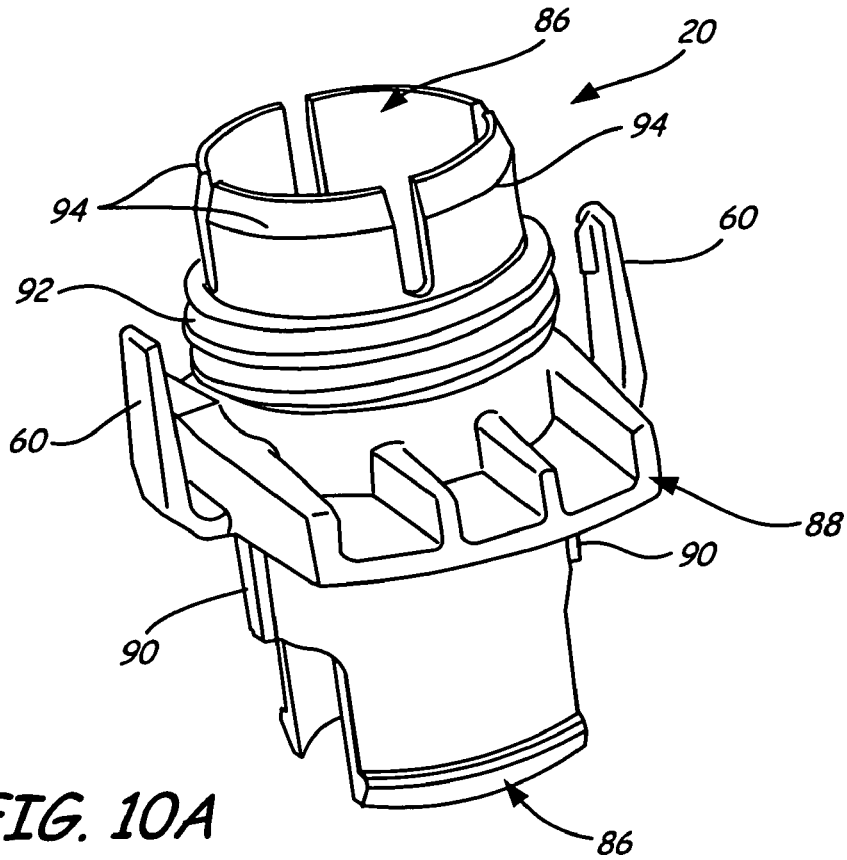
FIG. 10A is an elevated perspective view of one embodiment of the collet.
Figure 10B:
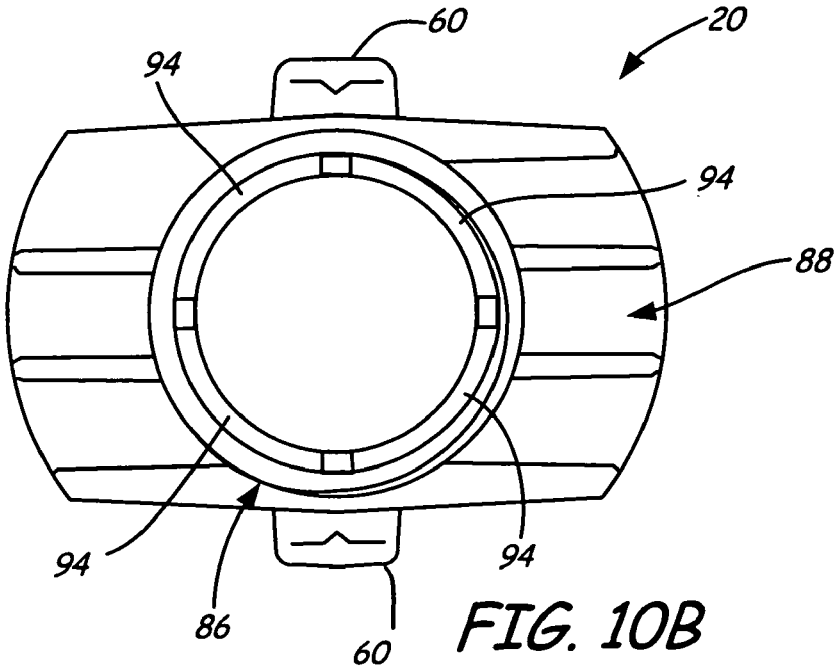
FIG. 10B is a top view of the collet of FIG. 10A.

FIGS. 10A and 10B show the collet 20. In addition to the arm projections 60, the collet 20 includes a receptacle 86 and a platform 88. The receptacle 86 includes ribs 90, threads 92, and deflectable fingers 94.

The hollow receptacle 86 extends from the upper edge of the collet 20 to the lower edge. The platform 88 projects from the outer surface of the receptacle 86 and extends therearound. The arm projections 60 extend upward from the platform 88 at a spaced apart distance to either side of the receptacle 86. The receptacle 86 has ribs 90 extending axially along the lower outer portion thereof. The threads 92 extend around the outer upper portion of the receptacle 86. The deflectable fingers 94 project upward from the upper portion of the receptacle 86.

The receptacle 86 receives the shaft of the trolling motor. The ribs 90 are received in the channels 74 of the coupling hinge 16 (FIGS. 7A to 7C). The channels 74 and ribs 90 seat the collet 20 in the tubular projection 68 of the coupling hinge 16. The ribs 90 keep the collet 20 from rotating with the rotation of the trolling motor. The threads 92 couple with corresponding threads on the resistance knob 22 (FIG. 5).

The deflectable fingers 94 are adapted to receive the shaft of the trolling motor and are received in the receptacle 64 of the resistance knob 22 (FIG. 5). The receptacle 64 is adapted to selectively engage (loosen or compress) the deflectable fingers 94 about the trolling motor as the resistance knob 22 is threaded with respect to the collet 20 (FIG. 5).

In one embodiment, the inboard facing portion of the platform 88 may be contacted by the nose 55 when the handle 34 of the lift arm 18 is depressed by the operator. The contact on the platform 88 raises the collet 20 within the coupling hinge 16. More particularly, the ribs 90 track upward within the channels 74 of the coupling hinge 16 (FIGS. 7A to 7C) as the coupling hinge 16 is raised upward by the lift arm 18. The movement of the collet 20 allows the locking pin 54 to be received in the notches 52A and 52B.

Figure 11A:
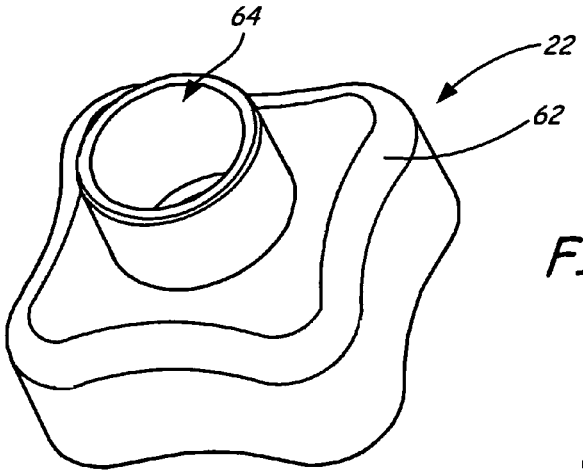
FIG. 11A is an elevated perspective view of one embodiment of the resistance knob.
Figure 11B:
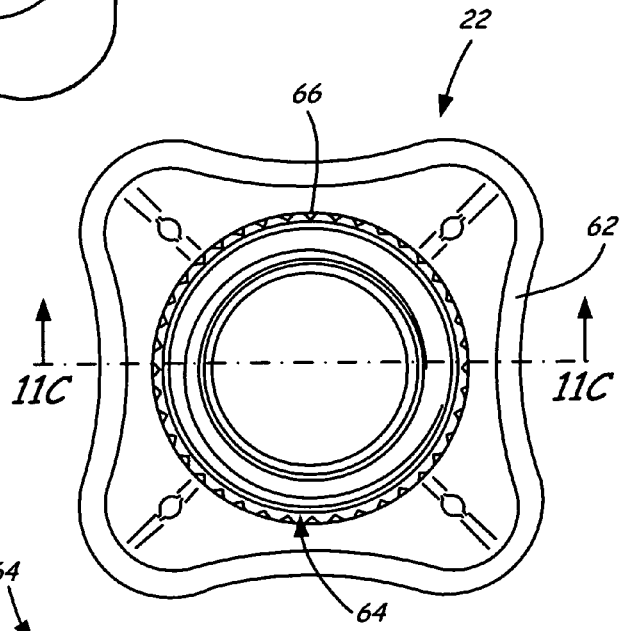
FIG. 11B is a bottom view of the resistance knob of FIG. 10A.
Figure 11C:
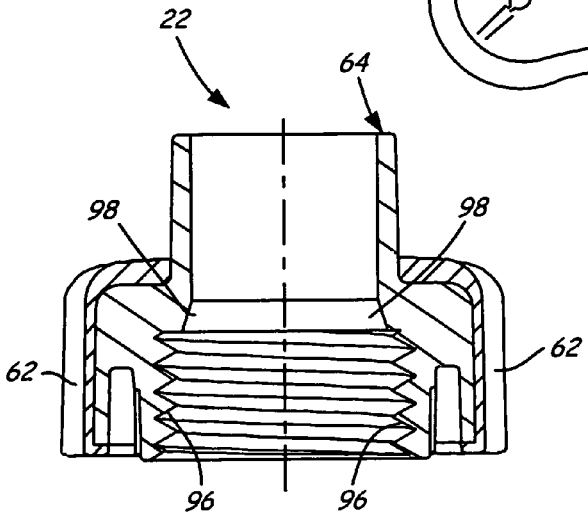
FIG. 11C is a side sectional view of the resistance knob of FIG. 11B.

FIGS. 11A to 11C show the resistance knob 22. In addition to the outer shell 62, a receptacle 64, and detents 66, the resistance knob 22 includes threads 96 and a camming surface 98.

The resistance knob 22 is assembled on the collet 20 (FIGS. 10A and 10B) and receives the shaft of the trolling motor through the upper portion thereof. More specifically, the upper portion of the receptacle 64 receives the trolling motor and the lower interior portion of the receptacle 64 is adapted with threads 96 therein. The camming surface 98 is disposed above the threads 96 and is swaged to decrease the internal diameter of the receptacle 64. The detents 66 are arrayed around the outer lower circumference of the receptacle 64. The lobed outer shell 62 extends around the receptacle 64.

The receptacle 64 receives the threads 92 and deflectable fingers 94 of the collet 20 (FIGS. 10A and 10B) when the resistance knob 22 is assembled on the collet 20. The deflectable fingers 94 insert in the receptacle 64 and contact the camming surface 98 as the threads 96 selectively mate with the threads 92 of the collet 20 (FIGS. 10A and 10B). In other words, the selective mating of the threads 96 and 92 loosens or compresses the deflectable fingers 94 about the trolling motor. More particularly, the contact between the deflectable fingers 94 and the camming surface 98 swages the deflectable fingers 94 about the trolling motor. The amount of swaging may be controlled by engaging or disengaging portions of the threads 96 with the threads 92 to insert or retract the deflectable fingers 94 a greater distance within the receptacle 64 along the camming surface 98. The selective interaction of the deflectable fingers 94 and the camming surface 98 due to the mating of the threads 96 and 92 adjusts the amount of force required by operator to rotatably steer the trolling motor. In one embodiment, the resistance knob 22 may be loosened sufficiently on the collet 20 to draw the shaft of the trolling motor through the collet 20 to extend or retract the trolling motor. This stowing means may be used to retract the trolling motor from the water when the trolling motor and bracket assembly 10 are in the deployed position.

The detents 66 selectively engage the arm projections 60 of the collet (FIGS. 10A and 10B) to resist the rotation of the resistance knob 22 on the collet 20. This resistance helps to hold the collet 20 and resistance knob 22 against the shaft of the trolling motor and provides for incremental adjustment of the tension of the collet 20 and resistance knob 22 against the shaft. The resistance provided by the engagement of the detents 66 with the projection arms 60 also makes it difficult or impossible for the operator to freely spin the resistance knob 22 on or off the collet 20. This feature increases the durability of the resistance knob 22 and collet 20 and decreases the danger that the resistance knob 22 will be rapidly loosened to allow the trolling motor to slide through the collet 20 and coupling hinge 16 and contact objects below the transom or gunnel.

Although the present invention has been described with reference to preferred embodiments, workers skilled in the art will recognize that changes may be made in form and detail without departing from the spirit and scope of the invention.

The invention claimed is:

1. A trolling motor apparatus for mounting to a watercraft, the apparatus comprising:

a trolling motor;

a bracket adapted to mount on a transom or a gunnel of the watercraft;

a coupling hinge adapted to receive and rotatably retain the trolling motor, wherein the coupling hinge and the bracket are adapted with surface profiles which form a track and a track follower to allow the coupling hinge to slide with respect to the bracket to move the trolling motor between a stowed position and a deployed position; and wherein the surface profiles of the coupling hinge and bracket each include a rib and a channel which are staggered with respect to one another to allow the coupling hinge to slide with respect to the bracket to move the trolling motor between the stowed position and the deployed position.

2. The apparatus of claim 1, wherein the bracket includes an array of detents extending therealong co-extensive with a portion of the channel.

3. The apparatus of claim 2, further comprising:

a lift arm pivotally coupled to the coupling hinge and configured to releasably engage the detents to lock the coupling hinge in multiple tilt angle positions with respect to the bracket.

4. The apparatus of claim 3, wherein the bracket, the rib and channel of the bracket, and the detents are configured with corresponding left and right interfacing portions and a portion of the coupling hinge and the lift arm are disposed between the interfacing portions of the bracket.

5. The apparatus of claim 3, further comprising a locking pin which is received in the lift arm and which acts as a pawl, wherein the locking pin extends generally between the interfacing portions to engage a portion of the detents which are configured as a ratchet, wherein the ratchet and pawl allow the coupling hinge to be manually inclined from the deployed position toward the stowed position without manually actuating the locking pin out of engagement with the detents.

6. The apparatus of claim 5, further comprising a first spring disposed between the lift arm and the coupling hinge which biases the locking pin into engagement with the detents, wherein the bias on the lift arm by the first spring must be manually overcome to actuate the locking pin out of locking engagement with the detents when the coupling hinge is declined from the stowed position toward the deployed position.

7. The apparatus of claim 6, further comprising a cam mechanism disposed between and rotatably interconnected with at least one of the interfacing portions of the bracket and adapted to receive a second spring, wherein the second spring biases a portion of the cam mechanism into the locking pin and overcomes the engaging bias of the first spring to disengage the locking pin from a lower section of the detents when the weight of the trolling motor is relieved from the coupling hinge.

8. The apparatus of claim 2, wherein the rib and the channel of the bracket extend in an arc over a transom or a gunnel of the watercraft and the detents are arrayed arcuately below and in communication with the channel.

9. The apparatus of claim 1, wherein the coupling hinge includes at least two ribs, an inner rib which is received in the channel of the bracket and an outer guide rib which guides the coupling hinge along the outer edge of the bracket.

10. The apparatus of claim 1, wherein the trolling motor, in response to stowing actuation by an operator pulling the trolling motor generally upward and then generally inward, moves along with the coupling hinge from the deployed position to the stowed position.

11. A trolling motor apparatus for mounting to a watercraft, the apparatus comprising:

a trolling motor;

a bracket adapted to mount on a transom or a gunnel of the watercraft;

a coupling hinge adapted to receive and rotatably retain the trolling motor, wherein the coupling hinge and the bracket are adapted with surface profiles which form a track and a track follower to allow the coupling hinge to slide with respect to the bracket to move the trolling motor between a stowed position and a deployed position;

a collet mounted to the coupling hinge and having a deflectable finger portion adapted to receive the trolling motor; and a resistance knob having a receptacle with a camming surface therein adapted to receive the deflectable finger portion of the collet;

wherein the resistance knob and the collet are configured with threaded portions which selectively mate to engage the deflectable finger portion against the camming surface of the receptacle to loosen or compress the deflectable finger portion of the collet about the trolling motor.

12. The apparatus of claim 11, wherein the collet is configured with arm projections which are received in the resistance knob, the resistance knob includes detents which selectively engage the arm projections to resist the rotation of the knob on the collet.

13. An apparatus for mounting a trolling motor to a watercraft, the apparatus comprising:

a bracket adapted to mount on a transom or a gunnel of the watercraft; and a coupling hinge adapted to receive and rotatably retain the trolling motor, wherein the coupling hinge and the bracket have corresponding male and female surface profiles which allow the coupling hinge to slide with respect to the bracket along the surface profile to move the trolling motor between a stowed position and a deployed position; and wherein the coupling hinge and bracket both have male and female surface profiles which are staggered to interleave the male and female surface profiles.

14. The apparatus of claim 13, wherein the surface profile of the bracket extends in an arc over the transom or the gunnel of the watercraft from adjacent an inboard side thereof to adjacent an outboard side thereof.

15. The apparatus of claim 13, wherein the coupling hinge, in response to actuation by an operator pulling the trolling motor generally upward and then generally inward, slides with respect to the bracket and move the trolling motor from the deployed position to the stowed position.

16. An apparatus for mounting a trolling motor to a watercraft, the apparatus comprising:

a bracket adapted to mount on a transom or a gunnel of the watercraft; and a coupling hinge adapted to receive and rotatably retain the trolling motor, wherein the coupling hinge and the bracket have corresponding male and female surface profiles which allow the coupling hinge to slide with respect to the bracket along the surface profile to move the trolling motor between a stowed position and a deployed position;

an arcuate array of detents extending along a portion of the bracket;

a lift arm pivotally coupled to the coupling hinge and configured to releasably engage the detents to lock the coupling hinge in multiple tilt angle positions including the stowed position and the deployed position;

a cam mechanism disposed between and rotatably interconnected with the bracket; and a spring that biases a portion of the cam mechanism into the lift arm to disengage the lift arm from a lower section of the detents when the trolling motor is manually actuated inward toward the stow position by an operator.

17. A trolling motor apparatus for mounting a trolling motor to a watercraft, the apparatus comprising:

a trolling motor;

a bracket adapted to mount on a transom or a gunnel of the watercraft;

a coupling hinge disposed partially between the bracket and adapted to receive and rotatably retain the trolling motor, the coupling hinge being movable in an arcuate path to multiple angle positions along the bracket; and a locking mechanism for locking the coupling hinge in multiple tilt angle positions with respect to the bracket; and wherein the coupling hinge is movable to multiple tilt angle positions with respect to the bracket by one hand manual actuation by an operator pulling the trolling motor generally upward and then generally inward toward themself to slide the coupling hinge arcuately with respect to the bracket.

18. A trolling motor apparatus for mounting a trolling motor to a watercraft, the apparatus comprising:

a trolling motor;

a bracket adapted to mount on a transom or a gunnel of the watercraft;

a coupling hinge disposed partially between the bracket and adapted to receive and rotatably retain the trolling motor, the coupling hinge being movable in an arcuate path to multiple tilt angle positions along the bracket; and a locking mechanism for locking the coupling hinge in multiple tilt angle positions with respect to the bracket;

an arcuate array of detents extending along the bracket; and a lift arm pivotally coupled to the coupling hinge and configured to releasably engage the detents to lock the coupling hinge in multiple tilt angle positions with respect to the bracket;

a ratchet portion of the detents;

a locking member which is received in the lift arm and is configured as a pawl, wherein the locking member engages the ratchet portion of the detents without locking the tilt angle of the coupling hinge with respect to the bracket as the coupling hinge is manually inclined upward toward the stowed position.

19. The apparatus of claim 18, further comprising:

a first spring disposed between the lift arm and the coupling hinge for biasing the locking member into engagement with the detents;

a cam mechanism disposed between and rotatably interconnected with the bracket; and a second spring received in the cam mechanism and contacting the bracket, for biasing a portion of the cam mechanism into the locking pin to disengage the locking member from a lower section of the detents when the trolling motor retained by the coupling hinge is manually actuated by the operator.

20. The apparatus of claim 19, wherein the bias exerted on the locking member by the second spring exceeds the bias exerted on the locking member by the first spring thereby allowing the cam mechanism to disengage the locking member from the ratchet portion of the detents when the weight of the trolling motor is relieved from the coupling hinge.

21. A trolling motor apparatus for mounting a trolling motor to a watercraft, the apparatus comprising:

a trolling motor;

a bracket adapted to mount on a transom or a gunnel of the watercraft;

a coupling hinge disposed partially between the bracket and adapted to receive and rotatably retain the trolling motor, the coupling hinge being movable in an arcuate path to multiple tilt angle positions along the bracket; and a locking mechanism for locking the coupling hinge in multiple tilt angle positions with respect to the bracket;

a collet mounted on the coupling hinge and having a deflectable finger portion adapted to receive the trolling motor; and a resistance knob having a receptacle with an internal camming surface adapted to receive the deflectable finger portion of the collet, wherein the resistance knob is movable with respect to the collet to loosen or compress the deflectable finger portion of the collet about the trolling motor.

* * * * *